US011297908B2

(12) United States Patent
Dobashi

(10) Patent No.: US 11,297,908 B2
(45) Date of Patent: Apr. 12, 2022

(54) CLASP MEMBER FOR ACCESSORY, CLASP FOR ACCESSORY, AND ACCESSORY

(71) Applicant: Crossfor Co., Ltd., Kofu (JP)

(72) Inventor: Hidetaka Dobashi, Kofu (JP)

(73) Assignee: Crossfor Co., Ltd., Kofu (JP)

( * ) Notice: Subject to any disclaimer, the term of this patent is extended or adjusted under 35 U.S.C. 154(b) by 0 days.

(21) Appl. No.: 17/044,469

(22) PCT Filed: Jul. 5, 2019

(86) PCT No.: PCT/JP2019/026859
§ 371 (c)(1),
(2) Date: Oct. 1, 2020

(87) PCT Pub. No.: WO2020/070939
PCT Pub. Date: Apr. 9, 2020

(65) Prior Publication Data

US 2021/0037928 A1 Feb. 11, 2021

(30) Foreign Application Priority Data

Oct. 3, 2018 (JP) ..... JP2018-188060
Jun. 19, 2019 (JP) ..... JP2019-113302

(51) Int. Cl.
*A44B 13/00* (2006.01)
*A44C 5/20* (2006.01)

(52) U.S. Cl.
CPC ..... *A44B 13/0029* (2013.01); *A44C 5/2019* (2013.01)

(58) Field of Classification Search
CPC .. A44B 13/0029; A44C 5/2019; A44C 5/2033
See application file for complete search history.

(56) References Cited

U.S. PATENT DOCUMENTS 1,637,699 A 8/1927 Lauterbach
2,157,288 A * 5/1939 Gauss ..... A44C 5/14 24/600.7

(Continued)

FOREIGN PATENT DOCUMENTS

CN 1161185 A 10/1997
CN 205568073 U 9/2016

(Continued)

OTHER PUBLICATIONS

International Search Report dated Jan. 21, 2020, in connection with corresponding international Application No. PCT/JP2019/046848 (3 pp.).

(Continued)

*Primary Examiner* — Robert Sandy
*Assistant Examiner* — Rowland Do
(74) *Attorney, Agent, or Firm* — Maier & Maier, PLLC

(57) ABSTRACT

A member for an accessory includes: a base portion that is connected to a part of an accessory; and a movable portion that is supported to be capable of turning relative to the base portion, and that opens and closes the clasp member for accessory by the turning. The clasp member is separably coupled to a coupling subject portion. A base-side coupling portion of the base portion is arranged on one side in a longitudinal direction of the base portion, the one side being opposite to another side on which a connecting part of the base portion is arranged, the connecting part being connected to the part of the accessory.

9 Claims, 16 Drawing Sheets

(56) References Cited

U.S. PATENT DOCUMENTS

| | | | | | |
|---|---|---|---|---|---|
| 2,215,526 | A * | 9/1940 | Kestenman | A44C 5/2042 | 24/601.5 |
| 2,874,435 | A | 2/1959 | Nielsen | | |
| 3,358,340 | A * | 12/1967 | Higuchi | A44B 11/2526 | 24/599.8 |
| 3,956,804 | A * | 5/1976 | Gatof | A44C 5/2038 | 24/598.5 |
| 4,411,050 | A | 10/1983 | Couture | | |
| 4,774,743 | A * | 10/1988 | Ziemelis | A44C 5/2042 | 24/116 A |
| 4,924,562 | A * | 5/1990 | Pogharian | A44C 5/2052 | 24/647 |
| 5,168,606 | A | 12/1992 | Ziemelis | | |
| 5,832,571 | A | 11/1998 | Kanamori | | |
| 6,553,636 | B1 * | 4/2003 | Brenner | A44C 5/2038 | 24/334 |
| D489,247 | S * | 5/2004 | Oyster | D8/367 | |
| 2009/0013721 | A1 | 1/2009 | Murao | | |
| 2016/0324276 | A1 * | 11/2016 | Collins | A44C 5/2038 | |

FOREIGN PATENT DOCUMENTS

| | | | |
|---|---|---|---|
| CN | 211833163 | U | 11/2020 |
| FR | 1.287.476 | A | 3/1962 |
| GB | 7200 | A | 1/1913 |
| JP | 49-122256 | B | 10/1974 |
| JP | 49-122256 | U | 10/1974 |
| JP | 56-047381 | Y | 10/1974 |
| JP | S57-99417 | U | 6/1982 |
| JP | S63-83020 | U | 5/1988 |
| JP | 5-293005 | A | 11/1993 |
| JP | H6-57216 | U | 8/1994 |
| JP | 7-027182 | A | 1/1995 |
| JP | 10-137016 | A | 5/1998 |
| JP | 2000-166625 | A | 6/2000 |
| JP | 3299724 | B2 | 7/2002 |
| JP | 3098584 | U | 3/2004 |
| JP | 3098789 | U | 3/2004 |
| JP | 3118764 | U | 2/2006 |
| JP | 2007-195606 | A | 8/2007 |
| JP | 3136049 | U | 10/2007 |
| JP | 2008-36244 | A | 2/2008 |
| JP | 3155597 | U | 11/2009 |
| JP | 2012-19946 | A | 2/2012 |
| JP | 2012-192157 | A | 10/2012 |

OTHER PUBLICATIONS

International Preliminary Report on Patentability dated Mar. 23, 2021, in connection with corresponding international Application No. PCT/JP2019/026859 (8 pp.).

International Preliminary Report on Patentability dated Mar. 23, 2021, in connection with corresponding international Application No. PCT/JP2019/034614 (10 pp.).

International Search Report dated Oct. 15, 2019 in corresponding International application No. PCT/JP2019/026859; 5 pages.

First CN Office Action dated Mar. 3, 2021, in connection with corresponding CN Application No. 201910892205.8 (20 pp., including machine-generated English translation).

First KR Office Action dated Jul. 26, 2021, in connection with corresponding KR Application No. 10-2020-7008419 (9 pp., including machine-generated English translation).

First KR Office Action dated Jul. 26, 2021, in connection with corresponding KR Application No. 10-2020-7008418 (14 pp., including machine-generated English translation).

First KR Office Action dated Jul. 26, 2021, in connection with corresponding KR Application No. 10-2020-7008417 (10 pp., including machine-generated English translation).

First CN Office Action dated Jun. 10, 2021, in connection with corresponding CN Application No. 201880003189.6 (12 pp., including machine-generated English translation).

First CN Office Action dated Jun. 22, 2021, in connection with corresponding CN Application No. 201980004809.2 (14 pp., including machine-generated English translation).

Chinese Office Action dated Oct. 18, 2021, in connection with corresponding CN Application No. 201910892205.8 (21 pp., including machine-generated English translation).

* cited by examiner

CLASP MEMBER FOR ACCESSORY, CLASP FOR ACCESSORY, AND ACCESSORY

FIELD

The present invention relates to a clasp member for accessory, a clasp for accessory, and an accessory.

BACKGROUND

Hitherto, the accessory such as a bracelet or a necklace is put on by wrapping a linear member such as a chain member or a string member around, for example, an arm or the neck. Generally, the accessory includes a fastening member that separably couples parts of the accessory to each other. For example, a fastening implement that is attached to one end portion and another end portion of the linear member of the accessory may include, as the fastening member, a pair of fastening members capable of being coupled to and separated from each other.

As examples of fastening implements of this type, a spring-ring type fastening implement disclosed in Japanese Patent Application Laid-open No. 2008-36244, a plug-in type fastening implement and a screw-type fastening implement disclosed, for example, in Japanese Patent Application Laid-open No. 10-137016 and Japanese Patent Application Laid-open No. 2012-19946 have been known. Of those, the spring-ring type fastening implement has been employed in most of the accessories. In addition, as examples of fastening implements of other types, a buckle-type fastening implement 150 illustrated in FIG. 16, and a fastening implement of a type disclosed in Japanese Patent Application Laid-open No. 2000-166625 also have been known.

SUMMARY

However, the related-art fastening implements are poor in operability. Specifically, for example, in putting on the accessory, or in taking off the accessory from the body, a fine operation with fingertips may be required to open and close the fastening member. In addition, in coupling the pair of fastening members forming the fastening implement to each other, for example, the following fine coupling operation needs to be performed. In this coupling operation, first, one of the fastening members is opened by a fine operation to form a small opening portion (gap). In this state, another one of the fastening members is inserted into this small opening portion in alignment therewith. In particular, with regard to the bracelet, the fine operation may need to be performed only with one hand. With regard to the necklace, the fine operation may need to be performed behind the neck without direct looking.

Thus, in operating the related-art fastening implement attached to the accessory, a user may feel the operations of the fastening members and the fastening implement difficult and troublesome. In this way, the related-art fastening implements have inconvenienced the user who puts on the accessories with the related-art fastening implements. In addition, for example, when the linear member of the accessory has a design feature, depending, for example, on structure of the fastening implement, the continuous design feature of the linear member may be impaired. As a result, an aesthetic appearance of the accessory may be impaired.

Further, with regard to the buckle-type fastening implement 150 illustrated in FIG. 16, in coupling a first member 151 and a second member 152 to each other, a first coupling portion 151*a* of the first member 151 needs to be moved to a vicinity of support portions 152*a* by passing an entirety of a movable-side body portion 152*b* through the first coupling portion 151*a*. However, a distal end portion of the movable-side body portion 152*b* is curved. In addition, a protruding piece portion 152*c*, which is formed to protrude from the movable-side body portion 152*b* so as to facilitate an operation to turn the movable-side body portion 152*b*, causes a disadvantage peculiar to the buckle-type fastening implement. Specifically, the first coupling portion 151*a* and the long movable-side body portion 152*b* or the protruding piece portion 152*c* of the second member 152 interfere with each other, which is liable to hinder the first coupling portion 151*a* from being moved to the support portions 152*a*.

Still further, normally, in order to prevent the first member 151 from catching on the movable-side body portion 152*b* of the second member 152, the ring-like first coupling portion 151*a* may be enlarged. However, in this case, downsizing of the fastening implement 150, in particular, downsizing of the first member 151 is hindered. In addition, the aesthetic appearance of the accessory may be significantly impaired by the fastening implement 150.

An object of the present invention is to provide a clasp member for accessory that allows operations to open and close a fastening member, and operations to couple and separate a fastening implement to be easily and smoothly performed.

Solution to Problem

In order to achieve the above-mentioned object, the clasp member for accessory to be provided according to the present invention includes the following aspect. Specifically, the clasp member for accessory according to the aspect of the present invention is a clasp member for accessory that is separably coupled to a coupling subject portion, and that includes:

a base portion that is connected to a part of an accessory; and a movable portion that is supported to be capable of turning relative to the base portion, and that opens and closes the clasp member for accessory by the turning.

The base-side coupling portion is arranged on one side in a longitudinal direction of the base portion, the one side being opposite to another side on which a connecting part of the base portion is arranged, the connecting part being connected to the part of the accessory, the movable portion includes a movable-side coupling portion, and under a state in which the movable portion is arranged at a closed position where the movable portion closes the fastening member, an inner peripheral portion or an outer peripheral portion of the movable-side coupling portion and an outer peripheral portion or an inner peripheral portion of the base-side coupling portion are held in contact with or face each other, and a part of the base-side coupling portion and a part of the movable-side coupling portion are superimposed on each other in the longitudinal direction of the base portion.

A clasp for accessory according to the aspect of the present invention includes:

a first fastening member being the clasp member for accessory according to the aspect of the present invention; and a second fastening member including the coupling subject portion.

An accessory according to the aspect of the present invention includes the clasp member for accessory according to the aspect of the present invention.

Advantageous Effects of Invention

The clasp member for accessory according to the present invention allows the operations to open and close the fastening member and the operations to couple and separate the fastening implement to be easily and smoothly performed. In addition, the clasp member for accessory is capable of stably maintaining a coupled state of the fastening implement.

DETAILED DESCRIPTION OF EMBODIMENTS

Below, a preferred embodiment of the present invention is described in detail by way of specific embodiments and with reference to the drawings. Note that, the present invention is not limited at all to configurations according to the embodiments described below. Various modifications may be made as long as configurations substantially the same as the configurations of the present invention are provided, and as long as functions and advantages similar to those of the present invention are provided.

Figure 1:
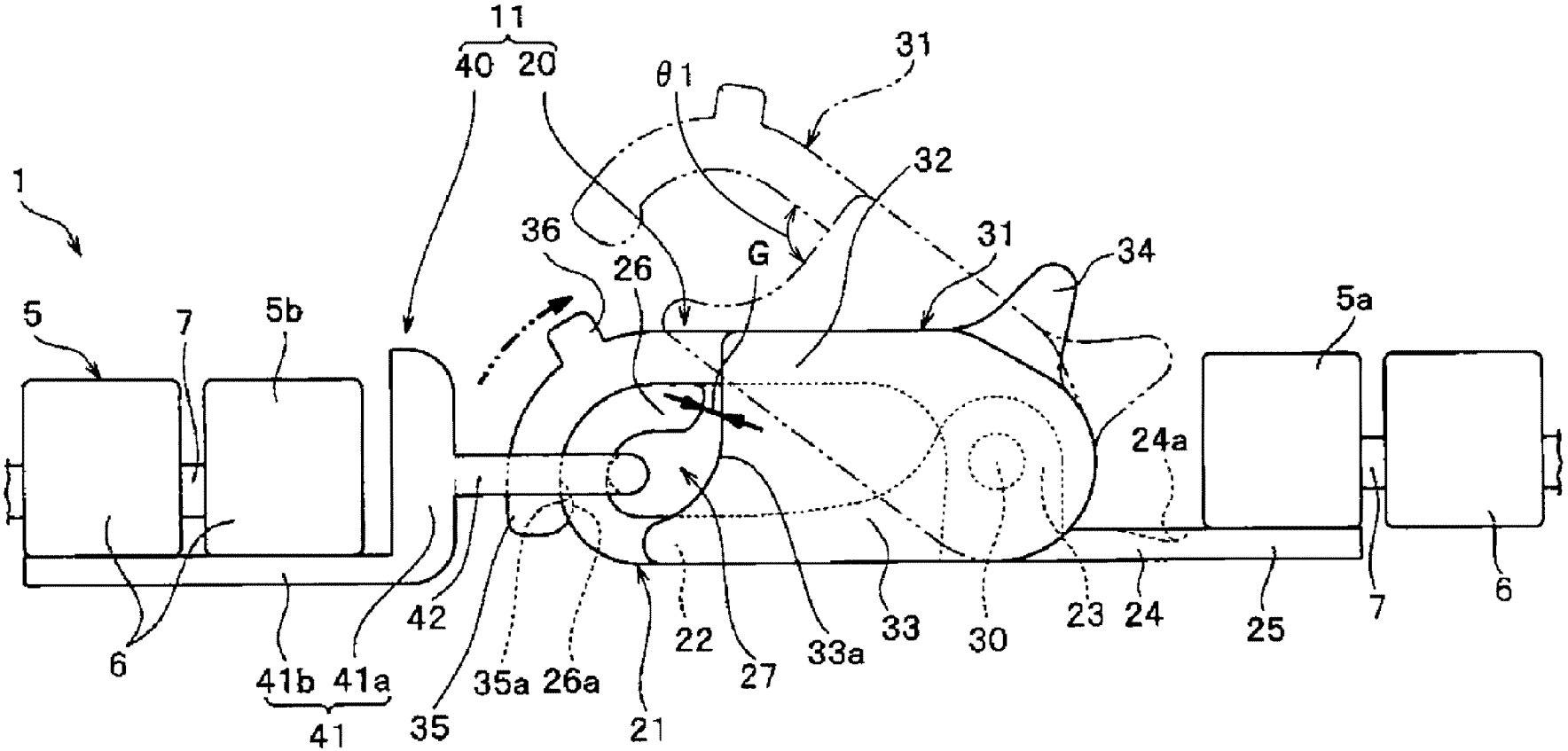
FIG. 1 A schematic side view of a fastening implement to be used in a first embodiment of the present invention.

In the embodiments described below, a direction along force in pulling one end portion and another end portion of a linear member in directions away from each other under a state in which a fastening implement is coupled (that is, direction along the pulled linear member) is defined as a longitudinal direction and a front-and-rear direction of the fastening implement. In this case, a longitudinal direction and a front-and-rear direction of a fastening member are directions parallel respectively to the longitudinal direction and the front-and-rear direction of the fastening implement. For example, in a case of a first embodiment of the present invention, a right-and-left direction in a drawing sheet of FIG. 1 at a time when FIG. 1 is viewed in an orientation in which reference symbols (numerals) are properly read corresponds to the front-and-rear direction of the fastening implement. For example, when the fastening member according to the present invention is separably coupled to a part of an accessory, which does not form the fastening implement, or when the fastening member according to the present invention is separably coupled to a member other than the accessory, the longitudinal direction and the front-and-rear direction of the fastening member correspond to directions along pulling directions at a time when the fastening member according to the present invention and a section on a side to which the fastening member is directly coupled are pulled in directions away from each other. In this case, in the accessory, or in the member other than the accessory, the section to which the fastening member is directly coupled refers to a coupling subject portion.

Further, a direction along a line of intersection of a plane orthogonal to the longitudinal directions and a plane including a turning direction of a movable portion provided to the fastening member is defined as a height direction and an upper-and-lower direction of the fastening implement. In this case, of sides in the upper-and-lower direction of the fastening implement under a state in which the accessory including the fastening implement is put on in a predetermined proper posture, one that is close to the skin is defined as a lower side, and another one that is away from the skin is defined as an upper side. A height direction and an upper-and-lower direction of the fastening member are directions along the height direction and the upper-and-lower direction of the fastening implement. For example, in the first embodiment, an upper-and-lower direction in the drawing sheet of FIG. 1 corresponds to the upper-and-lower direction of the fastening implement.

Still further, a direction orthogonal to the longitudinal direction and the height direction of the fastening implement is defined as a width direction and a right-and-left direction of the fastening implement. These width direction and right-and-left direction correspond to directions parallel to a rotary shaft of the movable portion of the fastening member. In this case, a width direction and a right-and-left direction of the fastening member correspond respectively to directions parallel to the width direction and the right-and-left direction of the fastening implement. For example, in the first embodiment, a front-and-back direction of the drawing sheet of FIG. 1 corresponds to the right-and-left direction of the fastening implement.

Herein, unless otherwise noted, a side view, a side view of the fastening member, and a side view of the fastening implement refer to those as viewed from a lateral surface in the width direction of the fastening implement under a state in which the movable portion of the fastening member according to the present invention is located at a closed position.

First Embodiment

Figure 2:
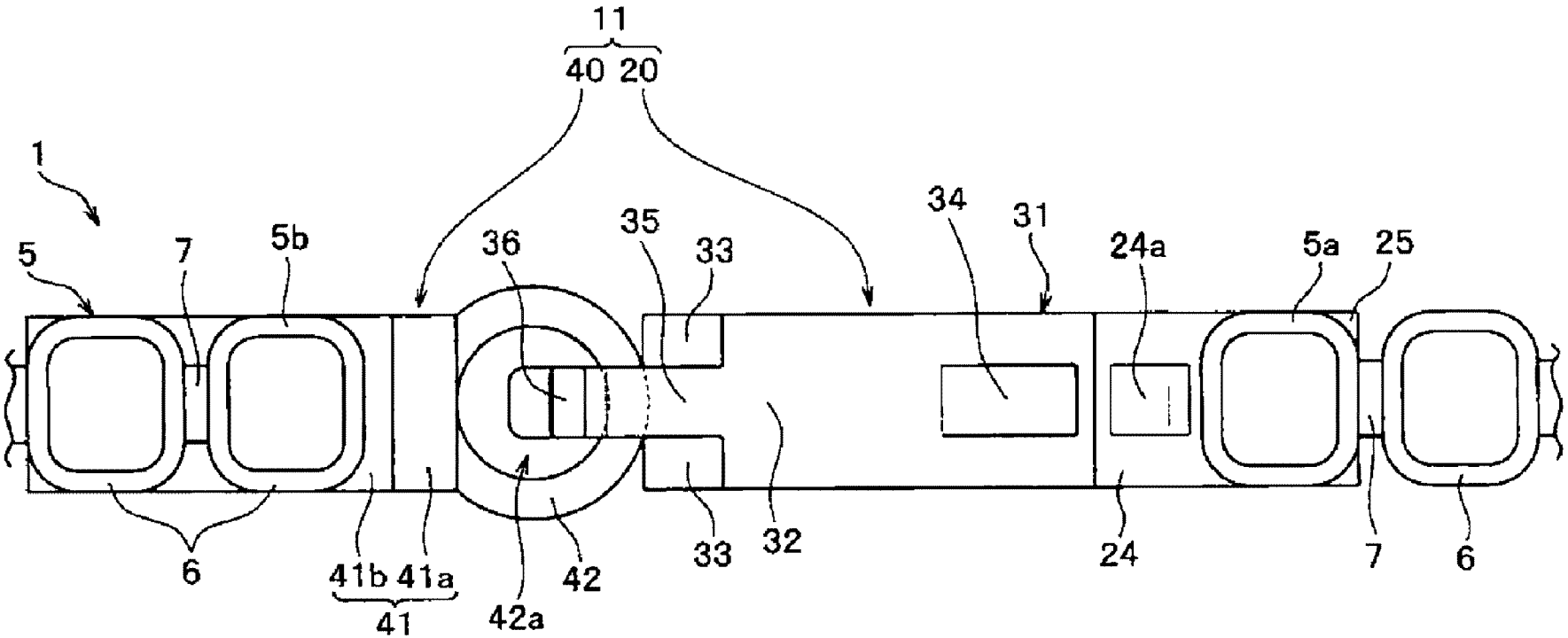
FIG. 2 A plan view in which the fastening implement illustrated in FIG. 1 is viewed from its upper surface side.
Figure 3:
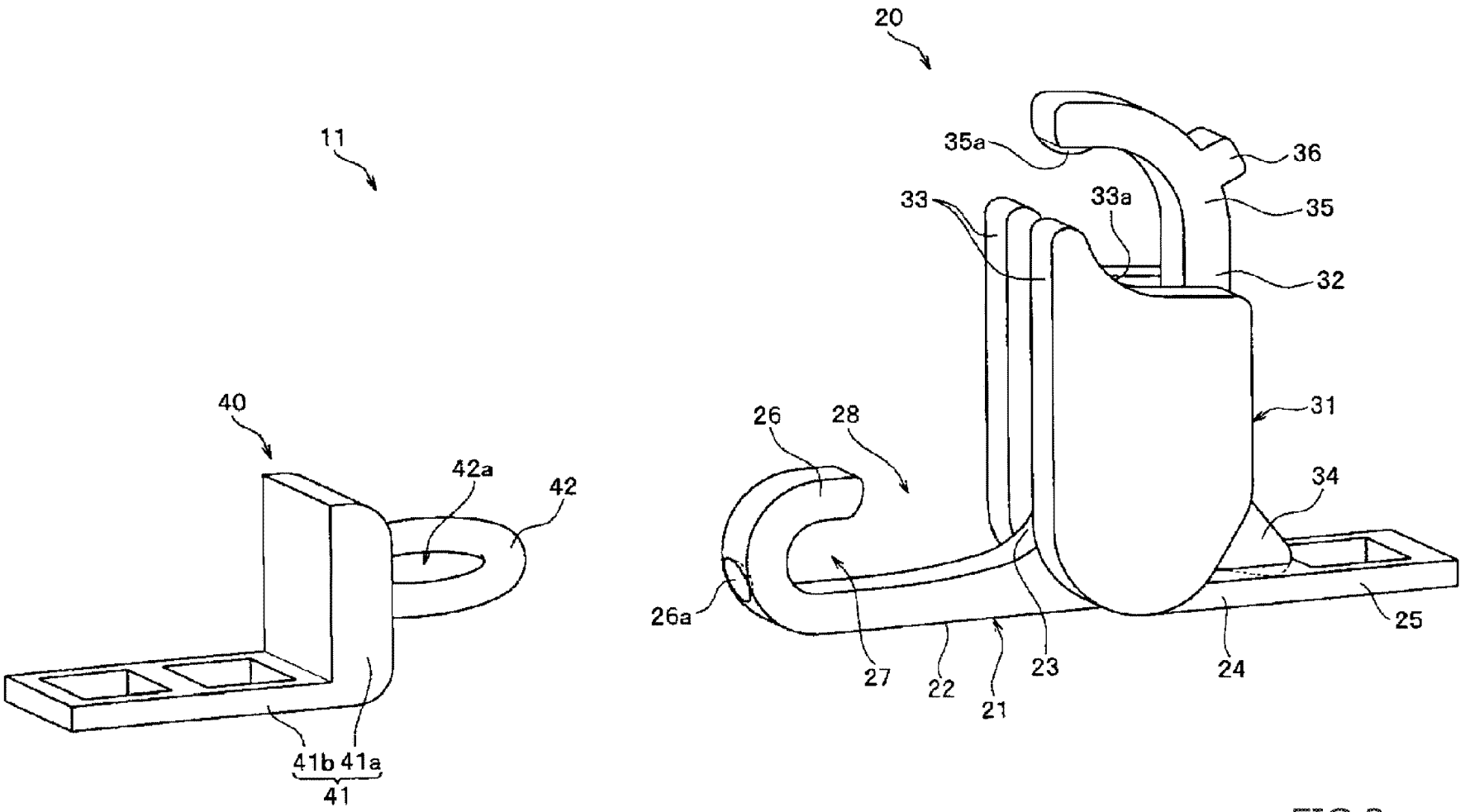
FIG. 3 A schematic perspective view illustrating a state in which a first fastening member and a second fastening member that form the fastening implement illustrated in FIG. 1 are separated from each other.
Figure 4:
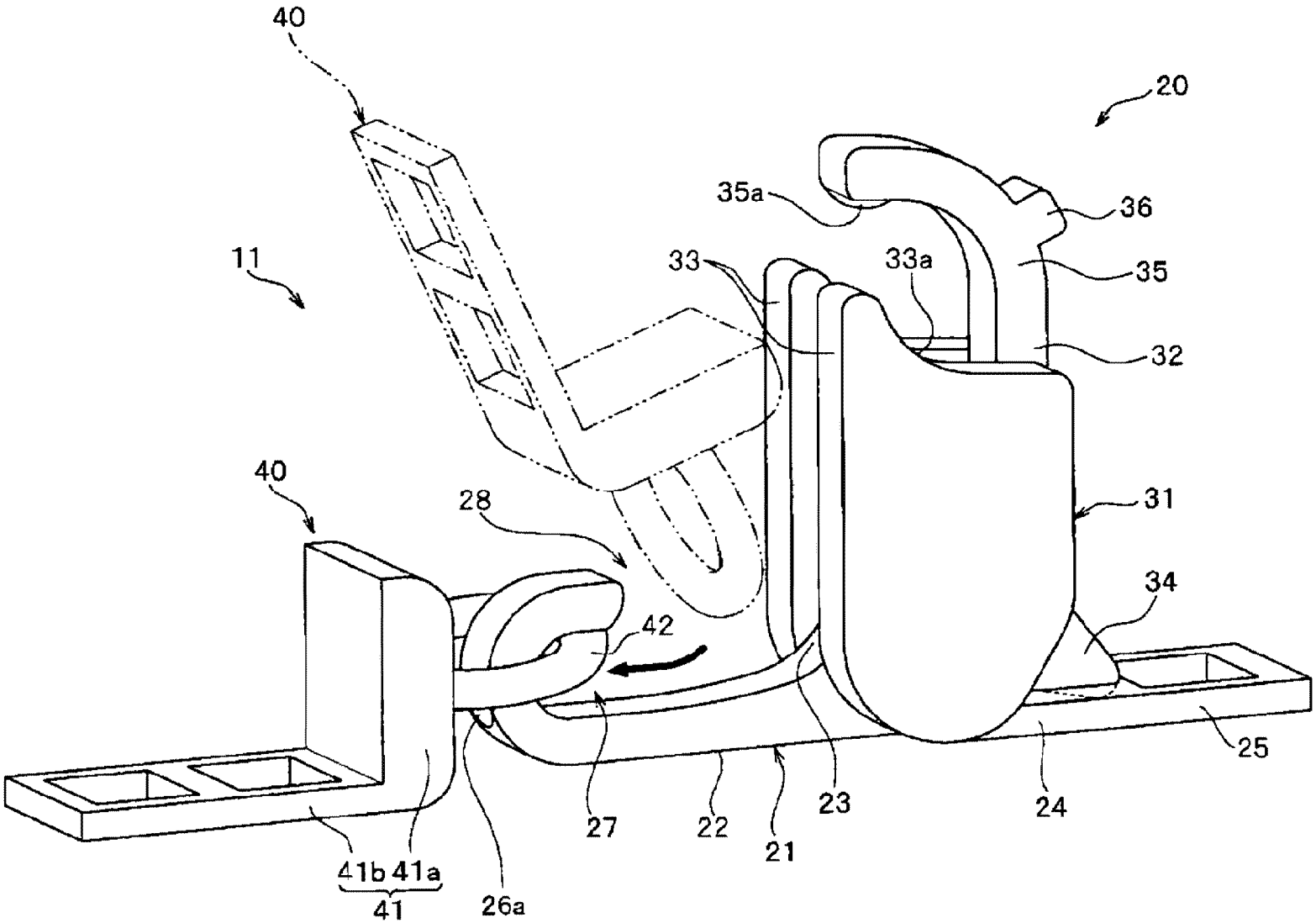
FIG. 4 A schematic perspective view illustrating a state in which the second fastening member illustrated in FIG. 3 is temporarily held by the first fastening member.

FIG. 1 and FIG. 2 are respectively a schematic side view and a schematic plan view of a fastening implement according to the first embodiment. FIG. 3 is a perspective view illustrating a state in which a first fastening member and a second fastening member of the fastening implement are separated from each other. FIG. 4 is a perspective view illustrating a state in which the second fastening member is temporarily held by the first fastening member.

In the first embodiment, as a typical example of the accessory, a case where the accessory is a tennis bracelet is described. Note that, the accessory according to the present invention is not limited to the tennis bracelet, and encompasses accessories other than the tennis bracelet.

A tennis bracelet 1 according to the first embodiment is an accessory to be put on a wrist. This tennis bracelet 1 includes a chain-like linear member 5 that serves as a bracelet body part (below, referred to as chain member 5), and a fastening implement 11 that is attached to both end portions of the chain member 5. This fastening implement 11 includes a first fastening member 20 and a second fastening member 40. By coupling the first fastening member 20 and the second fastening member 40 to each other, an entirety of the tennis bracelet 1 can be maintained in a ring shape. The first fastening member 20 according to the first embodiment is an example of the fastening member according to the present invention.

The chain member 5 of the tennis bracelet 1 includes a plurality of link portions 6, and coupling members 7 that couple adjacent two of the link portions 6 to each other. The coupling members 7 are attached to be swingable relative to the link portions 6. The link portions 6 each include a link body portion that is formed into a substantially quadrangular-cylindrical shape or a substantially cylindrical shape, and a gemstone (such as diamond) (not shown) to be fixed to an outer surface portion of the link body portion. Note that, the chain member 5 according to the first embodiment is one of specific examples of the linear member according to the present invention. As long as the first fastening member and the second fastening member of the fastening implement can be attached to both the end portions of the linear member according to the present invention, the linear member may be a flexible member other than the chain member, such as a string member.

The fastening implement 11 according to the first embodiment is made of a metal. The first fastening member 20 of the fastening implement 11 is attached to one end portion 5*a* of the chain member 5. The second fastening member 40 is attached to another end portion 5*b* of the chain member 5. The first fastening member 20 and the second fastening member 40 are separably coupled to each other.

The first fastening member 20 includes a base portion 21 that extends in the front-and-rear direction, and a movable portion 31 that is supported to be capable of turning relative to the base portion 21 by a coupling shaft portion 30 (also referred to as rotary portion). The base portion 21 is connected to the chain member 5 by being fixed thereto. The movable portion 31 is turned in a direction toward and away from the base portion 21. By turning the movable portion 31 in this way, the first fastening member 20 is opened and closed. Note that, the front-and-rear direction of the base portion 21, in which the base portion 21 extends, is parallel to a longitudinal direction of the first fastening member 20.

The movable portion 31 is held to be capable of turning about the coupling shaft portion 30 relative to the base portion 21 between a closed position where the first fastening member 20 is closed, and a full-open position. Note that, the closed position refers to a position where a movable-side coupling portion 35 described below of the movable portion 31 comes into abutment against a base-side coupling portion 26 described below of the base portion 21. This closed position corresponds to a turning limit position on a closing-direction side of the movable portion 31. The full-open position refers to a position where an operating portion 34 described below of the movable portion 31 comes into abutment against a turning stop portion 24 described below of the base portion 21, whereby the first fastening member 20 is most widely opened. The full-open position corresponds to a turning limit position on an opening-direction side of the movable portion 31.

The base portion 21 of the first fastening member 20 includes a base-side body portion 22 that extends in the front-and-rear direction, a base-side support portion 23 that extends upward from the base-side body portion 22, and the base-side coupling portion 26 that extends to be curved into a fish-hook shape or a circular-arc shape from its position in the base-side body portion 22, which is away from the base-side support portion 23. In addition, the base portion 21 includes the turning stop portion 24 that extends from the base-side body portion 22 toward the chain member 5 along the front-and-rear direction, and a first connecting portion 25 that extends further from the turning stop portion 24. Note that, in the following description, the state of extending to be curved into the fish-hook shape or the circular-arc shape may be simply referred to as "curved."

The base-side body portion 22 is formed to have a uniform dimension in the width direction. This base-side body portion 22 has a predetermined thickness so as to secure appropriate strength. Note that, the thickness of the base-side body portion 22 corresponds to a dimension in the upper-and-lower direction between an upper surface and a lower surface of the base-side body portion 22.

The base-side support portion 23 is arranged in a region on a side where the chain member 5 is provided relative to a central portion in the front-and-rear direction of the base-side body portion 22. Specifically, the base-side support portion 23 is provided at a part including an end portion on a side of the base-side body portion 22, which is close to the first connecting portion 25. Note that, the end portion on the side of the base-side body portion 22, which is close to the first connecting portion 25, corresponds to an end portion on a side away from the second fastening member 40. The base-side support portion 23 includes an upper end portion that exhibits a circular-arc shape in a side view (refer to FIG. 1) of the first fastening member 20. In addition, the base-side support portion 23 includes a part that is gradually reduced in dimension in the upper-and-lower direction toward the base-side coupling portion 26.

A dimension in the width direction of the base-side support portion 23 is substantially the same as the dimension in the width direction of the base-side body portion 22. Bearing recessed portions into which the coupling shaft portion 30 provided to the movable portion 31 is inserted are formed respectively in lateral surface portions on both sides in the right-and-left direction of the base-side support portion 23. The coupling shaft portion 30 of the movable portion 31 serves as a rotary shaft portion of the movable portion 31. By engaging the right-and-left bearing recessed portions of the base-side support portion 23 and the coupling shaft portion 30 of the movable portion 31 with each other, the movable portion 31 is supported to be capable of turning relative to the base portion 21. In the present invention, the base-side support portion 23 refers to a part including at least a range where the coupling shaft portion 30 of the movable portion 31 is provided in the side view of the first fastening member 20. In particular, in the case of the first embodiment, the base-side support portion 23 includes a part protruding upward from the base-side body portion 22 and including the circular-arc upper end portion.

The turning stop portion 24 extends continuously from the base-side body portion 22 so as to restrict a turning range of the movable portion 31 by allowing a part of the movable portion 31 to come into abutment against the turning stop portion 24 itself. A thickness of this turning stop portion 24 is smaller than the thickness of the base-side body portion 22. A dimension in the width direction of the turning stop portion 24 is larger than the dimension in the width direction of the base-side body portion 22.

The turning stop portion 24 includes a housing recessed portion 24*a*. The housing recessed portion 24*a* is provided at a central portion in the width direction of the turning stop portion 24, which corresponds to a position of the operating portion 34 of the movable portion 31. The housing recessed portion 24*a* is formed to be capable of housing a part of the operating portion 34 of the movable portion 31 to turn by allowing this part to come into abutment against the housing recessed portion 24*a* itself. In particular, in the first embodiment, the housing recessed portion 24*a* is formed to have a depth at which the turning range of the movable portion 31 is approximately 90°. Note that, the turning range of the movable portion 31 refers to a range where the movable portion 31 turns from the above-described closed position (refer to FIG. 1) to the above-described full-open position (refer to FIG. 3 and FIG. 4).

The first connecting portion 25 refers to a connecting part that is connected to the one end portion 5*a* of the chain member 5 by being fixed thereto. This first connecting portion 25 is formed of a rectangular frame-like thin plate piece. The first connecting portion 25 includes opening window portions each substantially conforming to a shape of an inside space to be provided in the link body portion of each of the link portions 6. The first connecting portion 25 is formed continuously from the turning stop portion 24, and has the same thickness and the same dimension in the width direction as those of the turning stop portion 24. The one end portion of the chain member 5 is fixed to the first connecting portion 25 by welding such as brazing.

Note that, in the present invention, the method of connecting the first connecting portion 25 of the base portion 21 and the one end portion 5*a* of the chain member 5 to each other is not particularly limited. For example, the first connecting portion 25 and the chain member 5 may be fixed to each other with adhesive. Alternatively, in the present invention, for example, the base portion may be formed without providing the first connecting portion 25, and the one end portion 5*a* of the chain member 5 may be directly fixed to a part of the base portion 21, such as the turning stop portion 24 or the base-side body portion 22, by welding, bonding, or the like. In this case, the part of the base portion 21, to which the one end portion of the chain member 5 is fixed by welding, bonding, or the like, serves as the connecting part where the base portion 21 is connected to the chain member 5.

The base-side coupling portion 26 extends to be curved into the fish-hook shape or the circular-arc shape toward the movable-side coupling portion 35 thereon from another end portion of the base-side body portion 22 on a side away from the chain member 5. A distal end portion of the base-side coupling portion 26 extends in a direction toward the base-side support portion 23. Note that, the distal end portion of the base-side coupling portion 26 refers to an end portion opposite to another end portion on a side where the base-side coupling portion 26 is coupled to the base-side body portion 22. A dimension in the width direction of the base-side coupling portion 26 is substantially the same as the dimension in the width direction of the base-side body portion 22.

In the side view of the first fastening member 20 (refer to FIG. 1), an inner space portion 27 is formed on an inner peripheral side of the base-side coupling portion 26. The inner space portion 27 is surrounded by an inner peripheral portion of the base-side coupling portion 26 and an inner peripheral portion of the base-side body portion 22. In the first embodiment, in the side view, the inner peripheral portion of the base-side coupling portion 26 is formed of a curved inner-peripheral surface of the base-side coupling portion 26. The inner space portion 27 is capable of housing a part of a second coupling ring 42 described below of the second fastening member 40.

Between the distal end of the base-side coupling portion 26 and lateral cover portions 33 described below of the movable portion 31, an insertion-and-removal opening portion 28 through which a part of the second fastening member 40 can pass is provided. This insertion-and-removal opening portion 28 refers to a space part or an opening part to be formed on an imaginary straight line between the base-side coupling portion 26 and the movable portion 31 in the side view of the first fastening member 20, the imaginary straight line being extended parallel to the front-and-rear direction from the distal end of the base-side coupling portion 26 toward the movable portion 31. When the first fastening member 20 is opened, the insertion-and-removal opening portion 28 is uncovered upward. At this time, the insertion-and-removal opening portion 28 of the first fastening member 20 and a space on an outside of the first fastening member 20 communicate with each other.

A size in the front-and-rear direction of the insertion-and-removal opening portion 28 varies in accordance with turning angle of the movable portion 31 relative to the base portion 21. In addition, depending on the turning angle of the movable portion 31, in the side view of the first fastening member 20, the distal end of the base-side coupling portion 26 is covered with the lateral cover portions 33 of the movable portion 31. At this time, the insertion-and-removal opening portion 28 is temporarily invisible.

The inner space portion 27 of the first fastening member 20 refers to a space portion that is arranged on a lower side in the upper-and-lower direction relative to an opening position along the front-and-rear direction of the insertion-and-removal opening portion 28. This inner space portion 27 and this insertion-and-removal opening portion 28 communicate with each other. Thus, in an operation to couple the first fastening member 20 and the second fastening member 40 to each other, the insertion-and-removal opening portion 28 along the front-and-rear direction is uncovered upward. With this, the insertion-and-removal opening portion 28 serves as an insertion port or an inlet for allowing the part of the second fastening member 40 to be inserted into the inner space portion 27. In an operation to separate the first fastening member 20 and the second fastening member 40 from each other, the insertion-and-removal opening portion 28 serves as a removal port or an outlet for allowing the part of the second fastening member 40 to be removed out of the inner space portion 27.

A length of the base-side coupling portion 26 according to the first embodiment is set so that a central angle of the curved circular-arc part in the side view of the first fastening member 20 is 135° or more. Note that, the base-side coupling portion 26 may be formed to have a size in which the central angle of the circular-arc part is 180° or more. This base-side coupling portion 26 is formed to have a length that does not reach a position of the lateral cover portions 33 described below of the movable portion 31 under a state in which the first fastening member 20 is closed (refer to FIG. 1). In this case, in the side view of FIG. 1, the distal end portion of the base-side coupling portion 26 does not hide in an inside in the width direction of the lateral cover portions 33.

In addition, in the base-side coupling portion 26, in the side view of FIG. 1 illustrating the state in which the first fastening member 20 is closed, a gap G is formed between the distal end of the base-side coupling portion 26 and restriction rim portions 33*a* described below of the lateral cover portions 33. A minimum value of this gap G is set so that the second coupling ring 42 described below of the second fastening member 40 is not allowed to be inserted therethrough. The minimum value of the gap G corresponds to a shortest distance between the base-side coupling portion 26 and the restriction rim portions 33*a* of the lateral cover portions 33. In other words, the gap G is formed to be smaller than a thickness of the second coupling ring 42 of the second fastening member 40. In the case of the first embodiment, the thickness of the second coupling ring 42 corresponds to a diameter of its circular shape in cross-section orthogonal to a circumferential direction of the second coupling ring 42.

In an outer surface portion of the base-side coupling portion 26, a locking recessed portion 26*a* that locks the movable portion 31 to the base portion 21 by allowing a locking-subject protruding portion 35*a* described below of the movable portion 31 to fit to the locking recessed portion 26*a* itself is provided in a recessed manner. In this case, the locking recessed portion 26*a* is formed into a shape of a concave surface that is recessed deepest at its central portion (refer to FIG. 1 and FIG. 3). The central portion of the locking recessed portion 26*a*, which is recessed deepest, is located below an intermediate position between a height position of the lower surface of the base-side body portion 22 and a height position of an outer peripheral surface of the distal end portion of the base-side coupling portion 26.

The movable portion 31 of the first fastening member 20 includes a movable-side body portion 32 that extends in the front-and-rear direction under the state illustrated in FIG. 1, in which the movable portion 31 is held at the closed position, and the movable-side coupling portion 35 that extends to be curved into a fish-hook shape or a circular-arc shape from the movable-side body portion 32 under the same state. Further, the movable portion 31 includes the lateral cover portions 33 that are provided on both right-and-left sides of the movable-side body portion 32, and that extend downward from the movable-side body portion 32 toward the base portion 21. Still further, the movable portion 31 includes the operating portion 34 that extends in a direction curved obliquely upward from the movable-side body portion 32 (also referred to as a tail portion), a protruding piece portion 36 that protrudes from the movable-side coupling portion 35 to the outside, and the locking-subject protruding portion 35*a* that is formed at a distal end portion of the movable-side coupling portion 35.

In the side view of FIG. 1, the movable-side body portion 32 is formed along the front-and-rear direction from a position superimposed on an outer peripheral surface of the base-side coupling portion 26 to a position above the base-side support portion 23. In addition, the movable-side body portion 32 is arranged at a position away from the base-side body portion 22. A dimension in the width direction of the movable-side body portion 32 is equal to or slightly larger than each of the dimension in the width direction of the base-side body portion 22 and the dimension in the width direction of the base-side coupling portion 26. By bringing this movable-side body portion 32 into abutment against the base-side coupling portion 26 of the base portion 21 together with the movable-side coupling portion 35, the first fastening member 20 is closed to shield the inner space portion 27 of the base portion 21 from the space on the outside in the side view.

The lateral cover portions 33 on both the right-and-left sides are continuous with the right-and-left lateral surface portions of the movable-side body portion 32, and hence are formed integrally with the movable-side body portion 32. In addition, the lateral cover portions 33 are each formed into a plate shape that droops downward from the position in FIG. 1, where the movable-side body portion 32 is arranged, toward the base-side body portion 22. Between the right-and-left lateral cover portions 33, a clearance into which the base-side support portion 23 of the base portion 21 can be inserted is provided.

A part of each of the lateral cover portions 33, which is on a side closest to the one end portion 5*a* of the chain member 5, is superimposed on the base-side support portion 23 of the base portion 21 in the side view of the first fastening member 20. In addition, this part is formed as a rotary coupling portion that is coupled to be capable of turning to the base-side support portion 23 by the coupling shaft portion 30. In other words, the rotary coupling portion of the movable portion 31, by which the movable portion 31 is coupled to be capable of turning relative to the base portion 21, is formed of the parts of the lateral cover portions 33.

On inner wall surfaces of the right-and-left lateral cover portions 33, which face each other, the coupling shaft portion 30 in a columnar shape is provided in a protruding manner in conformity with the bearing recessed portions of the base-side support portion 23. The coupling shaft portion 30 is arranged in a region of the rotary coupling portion of the lateral cover portions 33, which is superimposed on the base-side support portion 23 in the side view of the first fastening member 20.

In addition, under the state in which the movable portion 31 is held at the closed position, the right-and-left lateral cover portions 33 cover a part of the inner space portion 27 to be formed in the base portion 21 from lateral sides. In this case, the lateral cover portions 33 are each formed to have a size to be superimposed on at least a part of the base-side body portion 22 in the side view of the first fastening member 20. In particular, in the first embodiment, the lateral cover portions 33 are each formed to have a size in which lower edges of the lateral cover portions 33, which extend straight, and a lower edge of the base-side body portion 22, which extends straight, are superimposed on each other. With this, an appearance under the state in which the first fastening member 20 is closed can be enhanced, whereby quality of an external appearance of the fastening implement 11 can be increased.

The lateral cover portions 33 include the restriction rim portions 33*a* that extend downward from the position of the movable-side body portion 32 under the state in which the movable portion 31 is held at the closed position in the side view of the first fastening member 20. The restriction rim portions 33*a* refer to rim portions on a side in the front-and-rear direction of the lateral cover portions 33, which is close to the movable-side coupling portion 35. The movable portion 31 includes a space region that is surrounded by the restriction rim portions 33*a* of the lateral cover portions 33, the movable-side body portion 32, and the movable-side coupling portion 35 in the side view of the first fastening member 20. In this space region of the movable portion 31, an inner peripheral angle θ1 to be formed between the restriction rim portions 33*a* of the lateral cover portions 33 and the lower edge of the movable-side body portion 32 is 90° or less. How high this angle θ1 is represented by imaginary lines (two-dot chain lines) in FIG. 1, which indicate a part corresponding to the movable portion 31. In other words, the inner peripheral angle θ1 refers to an angle to be formed between the movable-side body portion 32 and the restriction rim portions 33*a* in the space region in the side view of the movable portion 31. Note that, this inner peripheral angle θ1 may be less than 90°, or may be 89° or less. As long as the first fastening member 20 and the second fastening member 40 can be coupled to each other, a lower limit value of this inner peripheral angle θ1 is not particularly limited.

Since the restriction rim portions 33*a* are provided to the lateral cover portions 33, a dimension in the front-and-rear direction of the lower end portion of each of the lateral cover portions 33 is larger than a dimension in the front-and-rear direction of an upper end portion of the same. In particular, the lateral cover portions 33 according to the first embodiment are each formed to have a size in which the gap G has the minimum value at which the second coupling ring 42 of the second fastening member 40 is not allowed to be inserted therethrough into the base-side coupling portion 26 under the state illustrated in FIG. 1, in which the first fastening member 20 is closed.

In the side view of the first fastening member 20, the operating portion 34 protrudes obliquely upward from an end portion on a side of the movable-side body portion 32, which is close to the chain member 5 of the movable-side body portion 32. By this operating portion 34, for example, in turning the movable portion 31 from the closed position in the opening direction, the operating portion 34 can be easily pushed with a finger or the like. With this, an operation to turn the movable portion 31 can be facilitated. Note that, in the present invention, the operating portion 34 is not particularly limited in shape. As long as the movable portion 31 can be pushed with a finger or the like, the operating portion 34 may be formed into a shape different from that in the first embodiment. For example, when the operating portion 34 is formed to be large in the width direction, the operating portion 34 can be easily pushed with a finger or the like.

The movable-side coupling portion 35 extends to be curved into the fish-hook shape or the circular-arc shape from an end portion of the movable-side body portion 32, which is opposite to the end portion on the side where the operating portion 34 is provided, toward the base-side coupling portion 26 thereunder. With regard to this movable-side coupling portion 35, an inner peripheral portion of the movable-side coupling portion 35 is capable of coming into abutment against at least a part of an outer peripheral portion of the base-side coupling portion 26 of the base portion 21. Note that, the movable-side coupling portion 35 may be formed so that the inner peripheral portion of the movable-side coupling portion 35 is held in surface contact with the outer peripheral portion of the base-side coupling portion 26 of the base portion 21. The inner peripheral portion of the movable-side coupling portion 35 is formed of a curved inner-peripheral surface of the movable-side coupling portion 35. In the side view of the first fastening member 20, this inner peripheral portion of the movable-side coupling portion 35 is arranged on a side closer to the coupling shaft portion 30 that serves as a rotary shaft of the movable portion 31 than an outer peripheral portion of the movable-side coupling portion 35 is close. The outer peripheral portion of the base-side coupling portion 26 is formed of the outer peripheral surface that is curved and arranged on a side opposite to a side on which the inner peripheral surface of the base-side coupling portion 26 is provided. In the side view of the first fastening member 20, the inner peripheral portion of the base-side coupling portion 26 is arranged on the side closer to the coupling shaft portion 30 than the outer peripheral portion of the base-side coupling portion 26 is close. In other words, in the present invention, the inner peripheral portion of the movable-side coupling portion 35 and the inner peripheral portion of the base-side coupling portion 26 are sections that are arranged on the side closer to the coupling shaft portion 30 that couples the base portion 21 and the movable portion 31 to each other. Meanwhile, the outer peripheral portion of the movable-side coupling portion 35 and the outer peripheral portion of the base-side coupling portion 26 are sections that are arranged on the side farther from the coupling shaft portion 30 than their respective inner peripheral portions are far.

With regard to the movable-side coupling portion 35, under the state in which the movable portion 31 is held at the closed position, the base-side coupling portion 26 and the movable-side coupling portion 35 are held while being superimposed on each other at least in the front-and-rear direction. In this case, the front-and-rear direction in which the base-side coupling portion 26 and the movable-side coupling portion 35 are superimposed on each other corresponds to a direction in which force is applied from the second coupling ring 42 of the second fastening member 40 to the first fastening member 20 when the first fastening member 20 and the second fastening member 40, which have been coupled to each other, are pulled in directions away from each other.

Note that, when the base-side coupling portion 26 is curved into a shape different from that in the first embodiment, the movable-side coupling portion 35 may be formed into a curved shape different from that in the first embodiment in conformity with the base-side coupling portion 26. In addition, for example, when the movable-side body portion 32 and the base-side coupling portion 26 are brought into contact with each other, the inner peripheral portion of the movable-side coupling portion 35 may face the outer peripheral portion of the base-side coupling portion 26 of the base portion 21 with a small gap therebetween, and the movable-side coupling portion 35 may be formed into such a shape or a size. In addition, in the present invention, the first fastening member may be formed while varying the base-side coupling portion and the movable-side coupling portion in size relative to each other so that, for example, the outer peripheral portion of the movable-side coupling portion can be brought into contact with or face the inner peripheral portion of the base-side coupling portion.

In the side view of the first fastening member 20, the protruding piece portion 36 protrudes obliquely upward from a curving-start part of the movable-side coupling portion 35 to the outside. In this case, under the state illustrated in FIG. 1, in which the first fastening member 20 and the second fastening member 40 are coupled to each other, the protruding piece portion 36 is arranged at a position relatively close to a second connecting-body portion 41*a* described below of the second fastening member 40. In particular, in the front-and-rear direction, the protruding piece portion 36 according to the first embodiment is arranged on a side closer to the second fastening member 40 than a position of the distal end of the base-side coupling portion 26 is close. Note that, the side closer to the second fastening member 40 corresponds to the side away from the first connecting portion 25 of the base portion 21. With this, degradation in feel of the fastening implement 11 against the skin due to the provision of the protruding piece portion 36 can be suppressed.

The protruding piece portion 36 is formed to have a size to be capable of being inserted, together with the base-side coupling portion 26 and the movable-side coupling portion 35, into an insertion hole portion 42*a* that is provided through the second fastening member 40 as described below. For example, in the case of the first embodiment, the protruding piece portion 36 is formed so that, in the side view of the first fastening member 20, a protruding length of the protruding piece portion 36 from the movable-side coupling portion 35 is the same as a thickness of the movable-side coupling portion 35, or smaller than the thickness of the movable-side coupling portion 35. The thickness of the movable-side coupling portion 35 corresponds to an interval between the inner peripheral surface and the outer peripheral surface of the movable-side coupling portion 35.

The locking-subject protruding portion 35*a* that swells toward an inside relative to the movable-side coupling portion 35 is formed at the distal end portion of the movable-side coupling portion 35. This locking-subject protruding portion 35*a* has a size to be capable of being inserted into the locking recessed portion 26*a* of the base-side coupling portion 26. This locking-subject protruding portion 35*a* is held by being inserted into the locking recessed portion 26*a* of the base-side coupling portion 26. With this, when the movable portion 31 is moved to the closed position, the movable-side coupling portion 35 is locked to the base-side coupling portion 26. In this way, the movable portion 31 can be maintained at the closed position.

The locking-subject protruding portion 35*a* is formed to swell into a spherical shape in a direction orthogonal to the turning direction of the movable portion 31. The direction orthogonal to the turning direction of the movable portion 31 refers to a direction orthogonal to the substantially-circular-arc movable-side coupling portion 35. In other words, in the side view of the first fastening member 20, a swelling surface of the locking-subject protruding portion 35*a* is formed to be curved into a circular-arc shape. In addition, the swelling curved surface of the locking-subject protruding portion 35*a* and a distal end surface of the movable-side coupling portion 35 are formed as surfaces that are smoothly continuous with each other in the side view of the first fastening member 20. With this, the locking-subject protruding portion 35*a* of the movable-side coupling portion 35 can be smoothly inserted into and removed from the locking recessed portion 26*a* of the base-side coupling portion 26.

Note that, in the present invention, a locking portion that locks the movable portion 31 at the closed position and means for locking the same are not particularly limited in configuration. As long as the movable portion 31 can be maintained at the closed position, the locking portion may be formed in another configuration. For example, the locking portion may be provided, for example, by forming recessed portions and protruding portions, which are engaged with each other, respectively in the lateral cover portions 33 and the base-side body portion 22. Alternatively, in the present invention, frictional force between the movable-side coupling portion 35 and the base-side coupling portion 26, elastic force of the movable-side coupling portion 35 and the base-side coupling portion 26, or the like may be utilized to lock the movable-side coupling portion 35 to the base-side coupling portion 26, thereby maintaining the movable portion 31 at the closed position. In this case, frictional force between the base portion 21 and the movable portion 31 or elastic force of an at least one of the base portion 21 and the movable portion 31 acts as the locking means for locking the movable portion 31 at the closed position. With this, even without providing, for example, the locking-subject protruding portion 35*a* and the locking recessed portion 26*a* according to the first embodiment, the movable portion 31 can be locked at the closed position. Still alternatively, for example, magnetic force to be generated by providing a magnet to an at least one of the movable-side coupling portion 35 and the base-side coupling portion 26 may be utilized to lock the movable-side coupling portion 35 to the base-side coupling portion 26.

The second fastening member 40 according to the first embodiment includes a second connecting portion 41 to which the other end portion of the chain member 5 is connected by being fixed, and the second coupling ring 42 that is formed integrally with the second connecting portion 41. The second connecting portion 41 includes the second connecting-body portion 41*a* having a height dimension corresponding to that of the chain member 5, and a thin-plate-like second connecting-piece portion 41*b* that extends from the second connecting-body portion 41*a* in the front-and-rear direction. In this case, the height dimension of the second connecting-body portion 41*a* is larger than that of the link body portion of each of the link portions 6. Opening window portions each substantially conforming to a shape of an inside space to be provided in the link body portion of each of the link portions 6 are formed through the second connecting-piece portion 41*b* in the upper-and-lower direction.

In the second fastening member 40, the other end portion of the chain member 5 is fixed to the second connecting-piece portion 41*b* by welding such as brazing at a position away from the second connecting-body portion 41*a*. Specifically, in the case of the first embodiment, two of the link portions 6 of the chain member 5 are fixed to the second connecting-piece portion 41*b* of the second connecting portion 41 so that the second fastening member 40 can be easily picked up with fingers.

Note that, in the present invention, the method of connecting the second fastening member to the other end portion of the chain member is not particularly limited. For example, the second fastening member and the other end portion of the chain member may be connected to each other by bonding with adhesive. Alternatively, the second fastening member and the other end portion of the chain member may be connected to each other with a round wire ring (also referred to as a jump ring).

The second coupling ring 42 extends along the front-and-rear direction from a substantially central portion in the upper-and-lower direction of a surface of the second connecting-body portion 41*a*, which is on a side opposite to a side on which the second connecting-piece portion 41*b* is provided. The insertion hole portion 42*a* is provided through the second coupling ring 42 in the upper-and-lower direction. In other words, the second coupling ring 42 is formed into a ring shape that exhibits, as viewed from above (refer to FIG. 2), a part of a circular shape or a part of an elliptical shape. When the first fastening member 20 and the second fastening member 40 are coupled to each other, a part of the second coupling ring 42 is hooked to and held by the base-side coupling portion 26 of the first fastening member 20. Thus, in the first embodiment, this second coupling ring 42 corresponds to the coupling subject portion to which the first fastening member 20 is coupled.

Note that, although the second coupling ring 42 according to the first embodiment is formed to exhibit the circular shape in the cross-section orthogonal to the circumferential direction, the second coupling ring 42 is not limited thereto. In the present invention, the second coupling ring 42 may be formed into other shapes such as a substantially quadrangular shape in the cross-section. Alternatively, the second coupling ring 42 may be formed into still other shapes in which the insertion hole portion 42*a* can be formed, such as a U-shape as viewed from above.

The insertion hole portion 42*a* of the second coupling ring 42 is opened to have a size in which both the base-side coupling portion 26 and the movable-side coupling portion 35 of the first fastening member 20 can be inserted through the insertion hole portion 42*a* itself when the first fastening member 11 and the second fastening member 21 are coupled to each other. In addition, in the size that the insertion hole portion 42*a* is opened to have, the protruding piece portion 36 of the first fastening member 20 can be inserted through the insertion hole portion 42*a* itself together with the base-side coupling portion 26 and the movable-side coupling portion 35. With this, the first fastening member 20 coupled to the second fastening member 40 can be moved in a direction indicated by a two-dot-chain-line arrow in FIG. 1. As a result, under the state in which the first fastening member 20 and the second fastening member 40 are coupled to each other, the second coupling ring 42 can be prevented from catching on the first fastening member 20. With this, for example, the second coupling ring 42 can be prevented from catching on the protruding piece portion 36 of the first fastening member 20. In this way, the movable portion 31 can be prevented from being turned in the direction in which the movable portion 31 is opened.

Note that, in the present invention, the second fastening member is not particularly limited in configuration, and may have an arbitrary configuration as long as the second fastening member includes at least the insertion hole portion through which the base-side coupling portion 26 and the movable-side coupling portion 35 of the first fastening member 20 can be inserted. For example, the second fastening member may be formed only of a ring portion such as the jump ring.

The operation to couple the first fastening member 20 and the second fastening member 40 to each other under a state in which the first fastening member 20 and the second fastening member 40 are separated from each other in the first embodiment is described. First, a finger or a nail is hooked to the protruding piece portion 36 of the first fastening member 20, or the operating portion 34 of the first fastening member 20 is pushed with the finger from above. With this, the movable portion 31 of the first fastening member 20 is turned in the direction in which the movable portion 31 is separated from the base-side body portion 22. In this case, the direction in which the movable portion 31 is separated from the base-side body portion 22 corresponds to a clockwise direction in FIG. 1. In this way, the first fastening member 20 is opened, and an upper side of the insertion-and-removal opening portion 28 that is arranged in the front-and-rear direction is uncovered (refer to FIG. 3). Since the protruding piece portion 36 and the operating portion 34 are provided to the first fastening member 20, this operation of the first fastening member 20 for turning the movable portion 31 can be easily performed with one hand by using either one of the protruding piece portion 36 and the operating portion 34. The insertion-and-removal opening portion 28 to be uncovered at this time serves as an inlet portion that introduces the second coupling ring 42 into the inner space portion 27.

Then, one of the first fastening member 20 and the second fastening member 40, which is held, for example, on the wrist, is moved toward another one of the first fastening member 20 and the second fastening member 40. Next, the second coupling ring 42 of the second fastening member 40, which is represented by two-dot chain lines in FIG. 4, is inserted into the widely opened insertion-and-removal opening portion 28 of the first fastening member 20. After that, the base-side coupling portion 26 is inserted through the insertion hole portion 42*a* of the second coupling ring 42. Then, the second coupling ring 42 is moved from the insertion-and-removal opening portion 28 into the inner space portion 27. Next, the second coupling ring 42 of the second fastening member 40 is brought into contact with the inner peripheral portion of the base-side coupling portion 26 of the first fastening member 20.

In this way, the second fastening member 40 can be temporarily held by being hooked to the base portion 21 of the first fastening member 20. This operation to temporarily holding the second fastening member 40 with the first fastening member 20 also can be easily performed with one hand. In addition, in the case of the first embodiment, the second coupling ring 42 of the second fastening member 40 is formed to exhibit the part of the circular shape or the part of the elliptical shape in the plan view. Thus, even when the second fastening member 40 is maintained in, for example, a posture inclined relative to the front-and-rear direction, the operation to temporarily holding the second fastening member 40 with the first fastening member 20 can be easily and smoothly performed.

Figure 16:
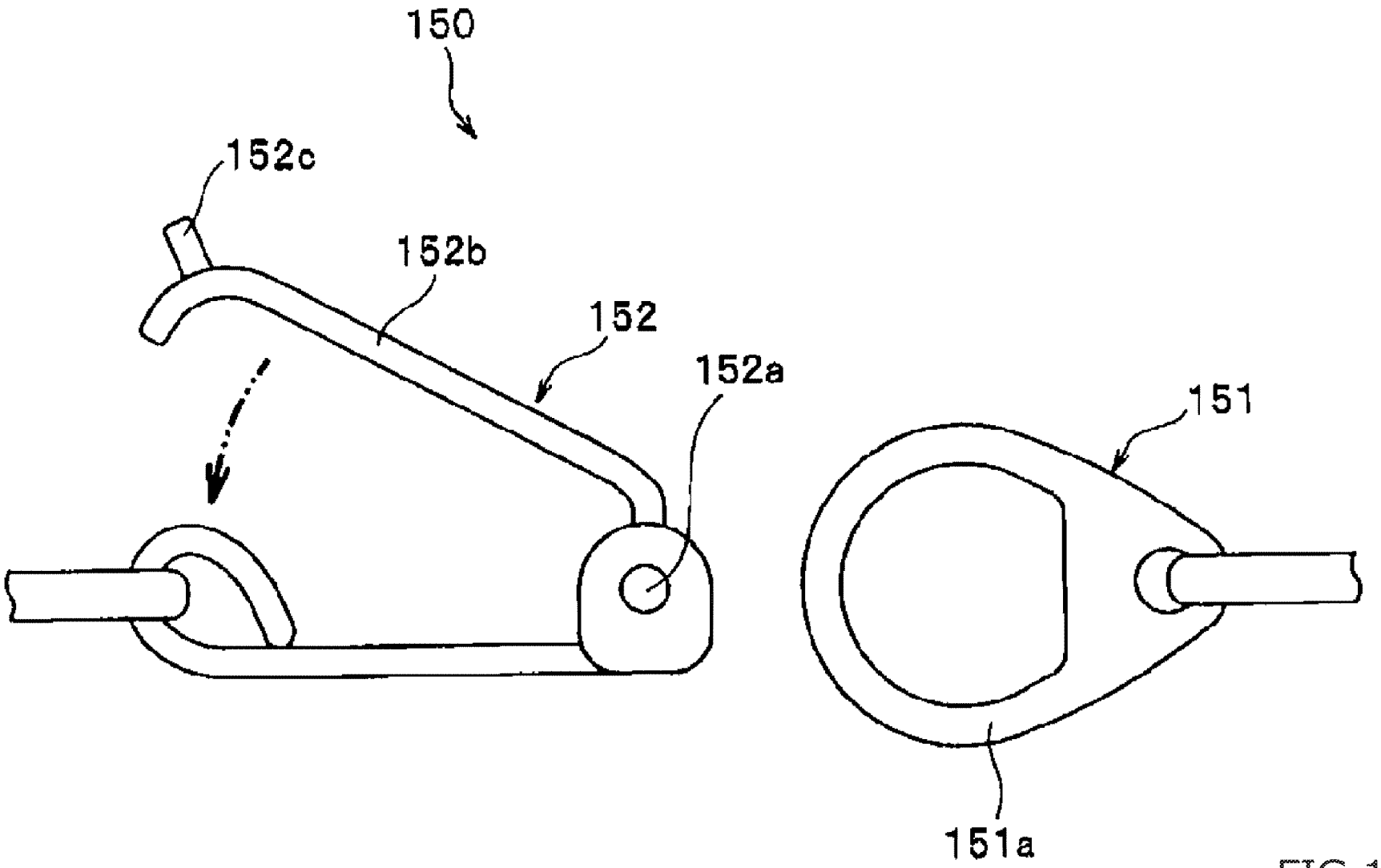
FIG. 16 A side view of a related-art fastening implement.

Further, in the first embodiment, the base-side coupling portion 26, which needs to be inserted through the insertion hole portion 42*a* of the second coupling ring 42 in temporarily holding the second fastening member 40 with the first fastening member 20, may be relatively short. For example, although the operation to insert the entirety of the long movable-side body portion 152*b* through the first coupling portion 151*a* needs to be performed with regard to the related-art fastening implement 150 illustrated in FIG. 16, such an operation is not performed in the first embodiment. Thus, in inserting the base-side coupling portion 26 through the insertion hole portion 42*a* of the second coupling ring 42, movements of the second coupling ring 42 and the base-side coupling portion 26 relative to each other are prevented from being hindered. With this, the temporarily holding operation can be smoothly performed even with one hand.

Still further, by temporarily holding the second fastening member 40 with the first fastening member 20 (refer to FIG. 4), the second fastening member 40 is prevented from being disengaged from the first fastening member 20. In addition, even under a state in which both the first fastening member 20 and the second fastening member 40 are not held with the fingers, weight of the chain member 5 causes the first fastening member 20 and the second fastening member 40 to be pulled in directions away from each other. Thus, the state in which the second fastening member 40 is temporarily held can be easily and stably maintained.

After the second fastening member 40 is temporarily held, the movable portion 31 of the first fastening member 20 is turned toward the base-side body portion 22. With this, the movable-side coupling portion 35 of the movable portion 31 is brought into abutment against the base-side coupling portion 26. This operation of the first fastening member 20 for turning the movable portion 31 also can be easily performed with one hand.

Further, by bringing the movable-side coupling portion 35 into abutment against the base-side coupling portion 26, the movable-side coupling portion 35 is arranged at the closed position. With this, the movable-side body portion 32 of the movable portion 31 closes the upper side of the insertion-and-removal opening portion 28 of the first fastening member 20. In this way, the first fastening member 20 is closed. At the same time, the base-side coupling portion 26 and the movable-side coupling portion 35 can be superimposed on each other at least in the front-and-rear direction. In this way, the first fastening member 20 and the second fastening member 40 are coupled to each other. As a result, the tennis bracelet 1 is maintained in the ring shape. Note that, the above-described series of operating method for coupling the first fastening member 20 and the second fastening member 40 to each other is merely an example. In the present invention, the operating method for coupling the first fastening member 20 and the second fastening member 40 to each other is not particularly limited.

At this time, in the first fastening member 20, by bringing the movable-side coupling portion 35 of the movable portion 31 into abutment against the base-side coupling portion 26, the movable-side coupling portion 35 can be restricted from being moved farther from the closed position to the base portion 21. Further, the movable-side coupling portion 35 can be inserted from above through the insertion hole portion 42*a* provided through the second coupling ring 42 of the second fastening member 40. Still further, the locking-subject protruding portion 35*a* of the movable portion 31 can be inserted into the locking recessed portion 26*a* provided in the base portion 21, whereby the movable portion 31 can be locked to the base portion 21.

Since not only the base-side coupling portion 26 but also the movable-side coupling portion 35 can be inserted through the insertion hole portion 42*a* of the second fastening member 40, the first fastening member 20 and the second fastening member 40 can be further securely coupled to each other. Further, since the base-side coupling portion 26 and the movable-side coupling portion 35 are superimposed on each other in the front-and-rear direction, even when the first fastening member 20 and the second fastening member 40 are forcefully pulled in the directions away from each other, the base-side coupling portion 26 and the movable-side coupling portion 35 are not liable to be deformed. Thus, the first fastening member 20 and the second fastening member 40 can be stably coupled to each other. Still further, since the movable portion 31 is locked to the base portion 21, the state in which the first fastening member 20 and the second fastening member 40 are coupled to each other can be stably maintained.

Further, in the first embodiment, the operation to couple the first fastening member 20 and the second fastening member 40 to each other is not performed without turning the movable portion 31 of the first fastening member 20. With this, orientations of an upper surface side and a lower surface side of the fastening implement 11 can be easily checked in performing the coupling operation, or can be unconsciously grasped. As a result, the tennis bracelet 1 can be prevented from being put on in an overturned state. With this, putting on the ornament in a correct orientation can be prompted.

Still further, in the first fastening member 20, under the state in which the movable portion 31 is held at the closed position, the inner space portion 27 can be covered with the lateral cover portions 33 of the movable portion 31 from the right-and-left sides. In addition, the restriction rim portions 33*a* are obliquely provided to the lateral cover portions 33. With this, a movable range of the second coupling ring 42 of the second fastening member 40 in the inner space portion 27 of the first fastening member 20 can be restricted.

Yet further, the gap G to be formed between the base-side contact portion of the first fastening member 20 and the restriction rim portions 33*a* of the lateral cover portions 33 is formed to have the size that does not allow the second coupling ring 42 to be inserted therethrough. With this, in coupling the first fastening member 20 and the second fastening member 40 to each other, the second coupling ring 42 of the second fastening member 40 can be stably retained within the inner space portion 27 of the first fastening member 20. Thus, the second coupling ring 42 can be prevented from directly coming into contact with the movable-side body portion 32. With this, the second coupling ring 42 can be prevented from pushing the movable portion 31 in the opening direction.

Yet further, in the fastening implement 11 according to the first embodiment, by the weight of the chain member 5, the force in the directions away from each other is applied to the first fastening member 20 and the second fastening member 40 coupled to each other. Thus, a structural advantage that the state in which the second coupling ring 42 is held in abutment against the base-side coupling portion 26 of the first fastening member is easily maintained is also provided. As a result, for example, occurrence of a risk that the second coupling ring 42 of the second fastening member 40 accidentally pushes and turns the movable portion 31 of the first fastening member 20 in the opening direction can be advantageously prevented. Thus, the first fastening member 20 and the second fastening member 40 can be prevented from being unknowingly separated from each other.

Yet further, even in a case where unexpected external force is applied to turn the movable portion 31, for example, to a position as indicated by the two-dot chain lines in FIG. 1, the movable portion 31 does not open any further even by being pulled by the chain member 5. In addition, in this case, the shortest distance between the lateral cover portions 33 and the distal end of the base-side coupling portion 26 of the first fastening member 20 is smaller than the thickness of the second coupling ring 42. With this, the second coupling ring 42 of the second fastening member 40 can be prevented from popping out of the inner space portion 27. As a result, the fastening implement 11 can be prevented from being disengaged.

Next, how the first fastening member 20 and the second fastening member 40 are separated from each other under the state illustrated in FIG. 1, in which the first fastening member 20 and the second fastening member 40 are coupled to each other, is described. First, the movable portion 31 of the first fastening member 20 is turned in the direction away from the base-side body portion 22. With this, the first fastening member 20 is opened to uncover the upper side of the insertion-and-removal opening portion 28. This operation of the first fastening member 20 for turning the movable portion 31 can be easily performed with one hand.

Next, the first fastening member 20 or the second fastening member 40 is pinched with fingers, and the second coupling ring 42 is moved from the inner space portion 27 of the first fastening member 20 into the insertion-and-removal opening portion 28. After that, the second coupling ring 42 is removed from between the base portion 21 and the movable portion 31 to the outside of the first fastening member 20. In this way, the first fastening member 20 and the second fastening member 40 can be easily and smoothly separated from each other only with one hand. Note that, in the present invention, the operating method for separating the first fastening member 20 and the second fastening member 40 from each other is not particularly limited.

The first fastening member 20 according to the first embodiment allows the operations to open and close the first fastening member 20 to be easily performed with one hand. With this, the operation to couple the first fastening member 20 and the second fastening member 40 of the fastening implement 11 to each other and the operation to separate these members from each other can be easily and smoothly performed only with one hand. Thus, the tennis bracelet 1 according to the first embodiment is capable of significantly increasing ease of the operations in opening and closing the first fastening member 20, and ease of the series of operations in coupling and separating the fastening implement 11 to be greater than those, for example, in the cases where the spring-ring type fastening implement and the plug-in type fastening implement in the related art are used. Thus, for example, even persons who are not good at handling the related-art fastening implements can effortlessly perform the operations to couple and separate the fastening implement 11 with respect to the tennis bracelet 1 including the first fastening member 20 according to the first embodiment. As a result, they can use the tennis bracelet 1 further handily and conveniently.

Further, in the fastening implement 11 according to the first embodiment, when the first fastening member 20 and the second fastening member 40 are coupled to each other (refer to FIG. 1), the base-side coupling portion 26 and the movable-side coupling portion 35 are inserted through the insertion hole portion 42*a* of the second fastening member 40 with the inner peripheral portion of the movable-side coupling portion 35 held in contact with the outer peripheral portion of the base-side coupling portion 26. In this case, for example, under the state in which the first fastening member 20 and the second fastening member 40 are pulled in the directions away from each other, the base-side coupling portion 26 and the movable-side coupling portion 35 are superimposed on each other along the front-and-rear direction in which the force is applied from the second coupling ring 42 of the second fastening member 40. Thus, tensile strength of the fastening implement 11 in the coupled state can be increased. As a result, the state in which the first fastening member 20 and the second fastening member 40 are coupled to each other can be further stably maintained.

Still further, in the first embodiment, a size of the first fastening member 20 can be easily changed overall without impairing the ease of operating the first fastening member 20. For example, the first fastening member 20 of the fastening implement 11 can be easily lengthened or shortened in the longitudinal direction. Thus, for example, when the chain member 5 of the accessory has a design feature, the size of the first fastening member 20, or both the size of the first fastening member 20 and a size of the second fastening member 40 can be easily adjusted in accordance with design. Thus, the continuous design feature of the chain member 5 can be easily maintained, and an aesthetic appearance of the accessory can be prevented from being impaired.

Second Embodiment

Figure 5:
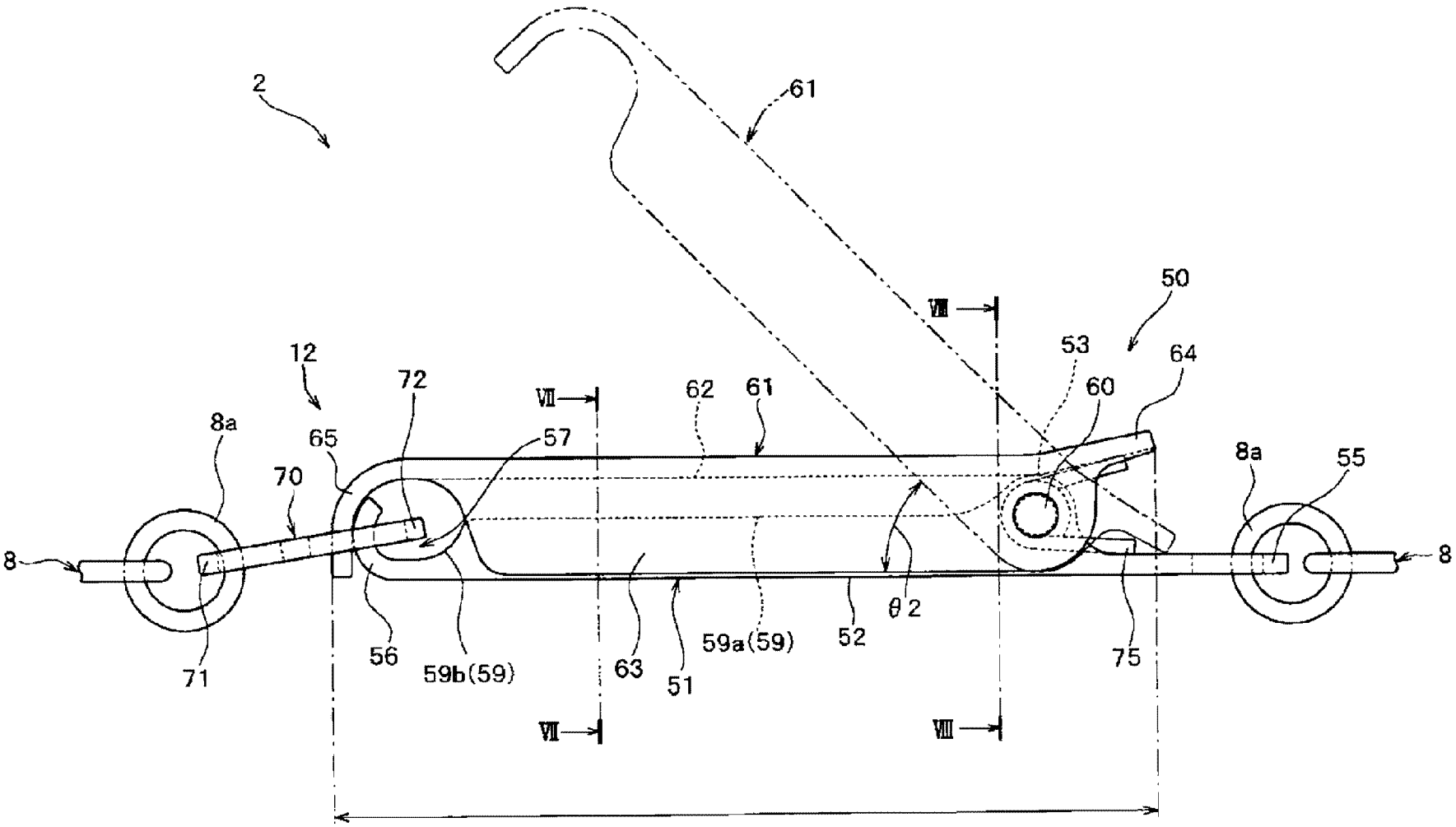
FIG. 5 A schematic side view of a fastening implement to be used in a second embodiment of the present invention.
Figure 6:
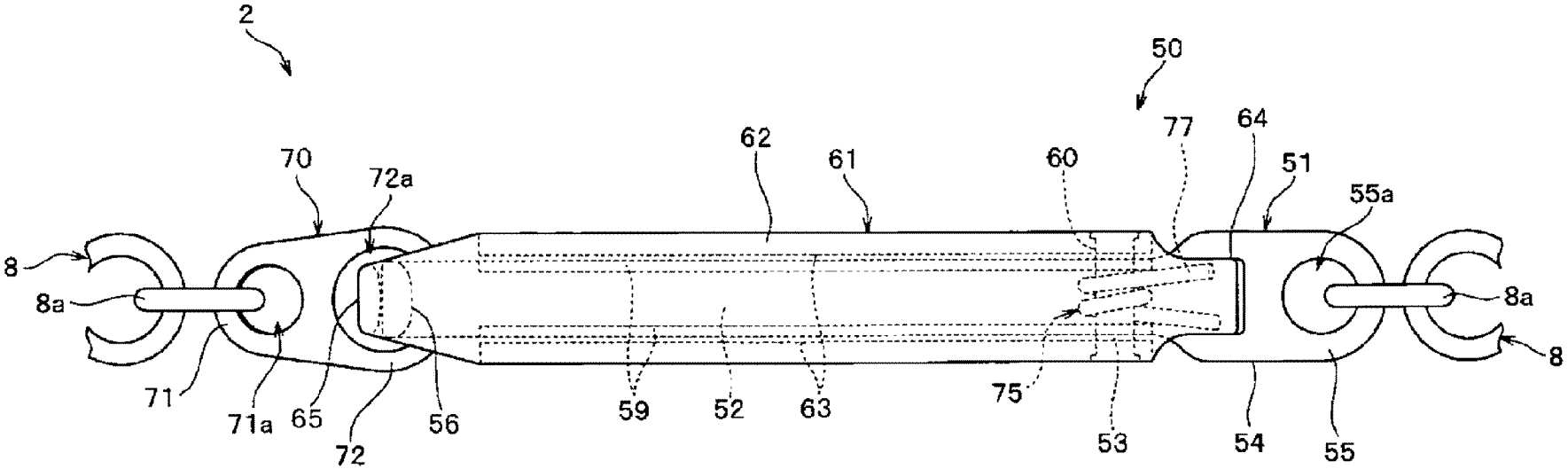
FIG. 6 A schematic plan view of the fastening implement illustrated in FIG. 5.
Figure 7:
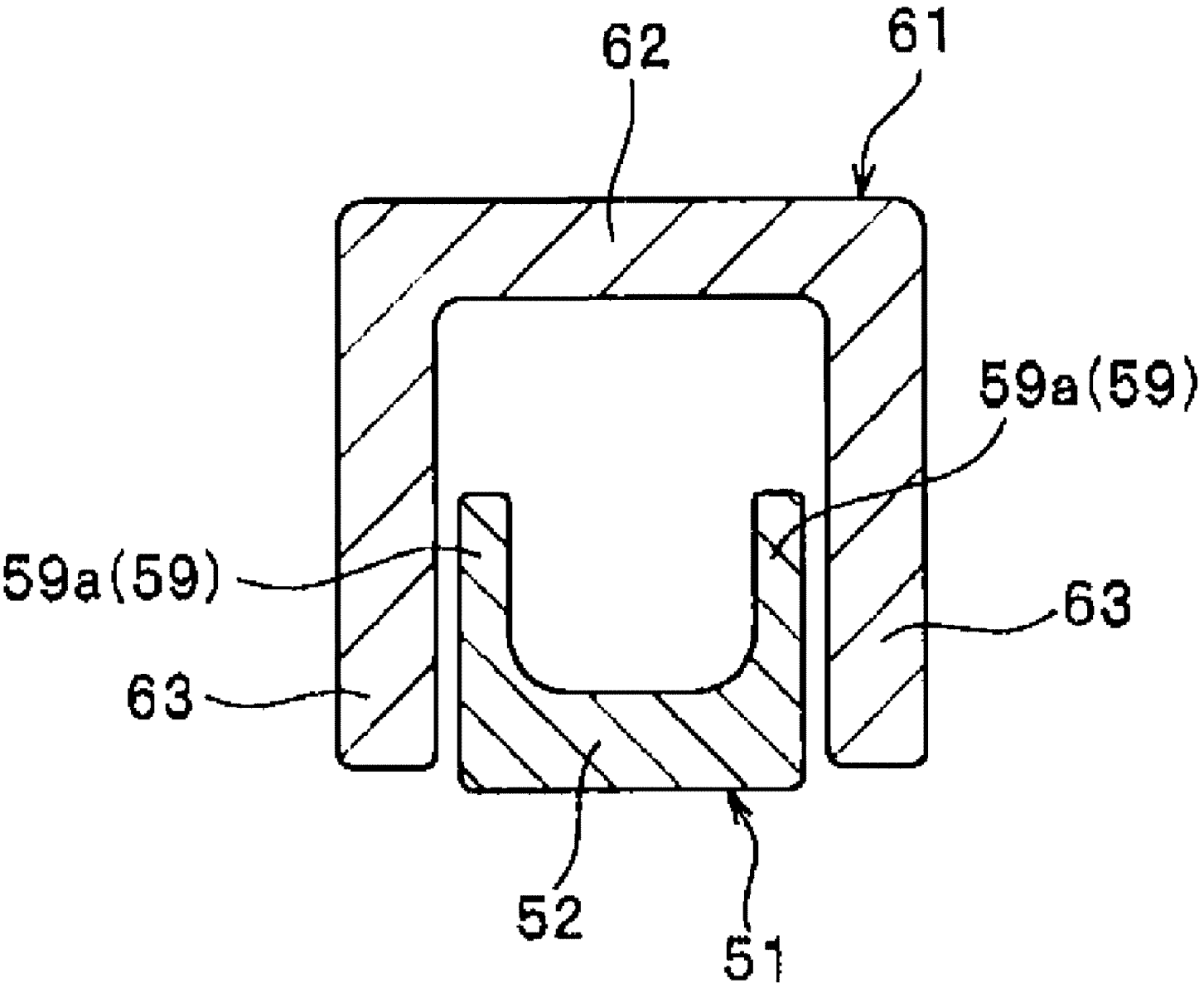
FIG. 7 A cross-sectional view taken along a line VII-VII shown in FIG. 5.
Figure 8:
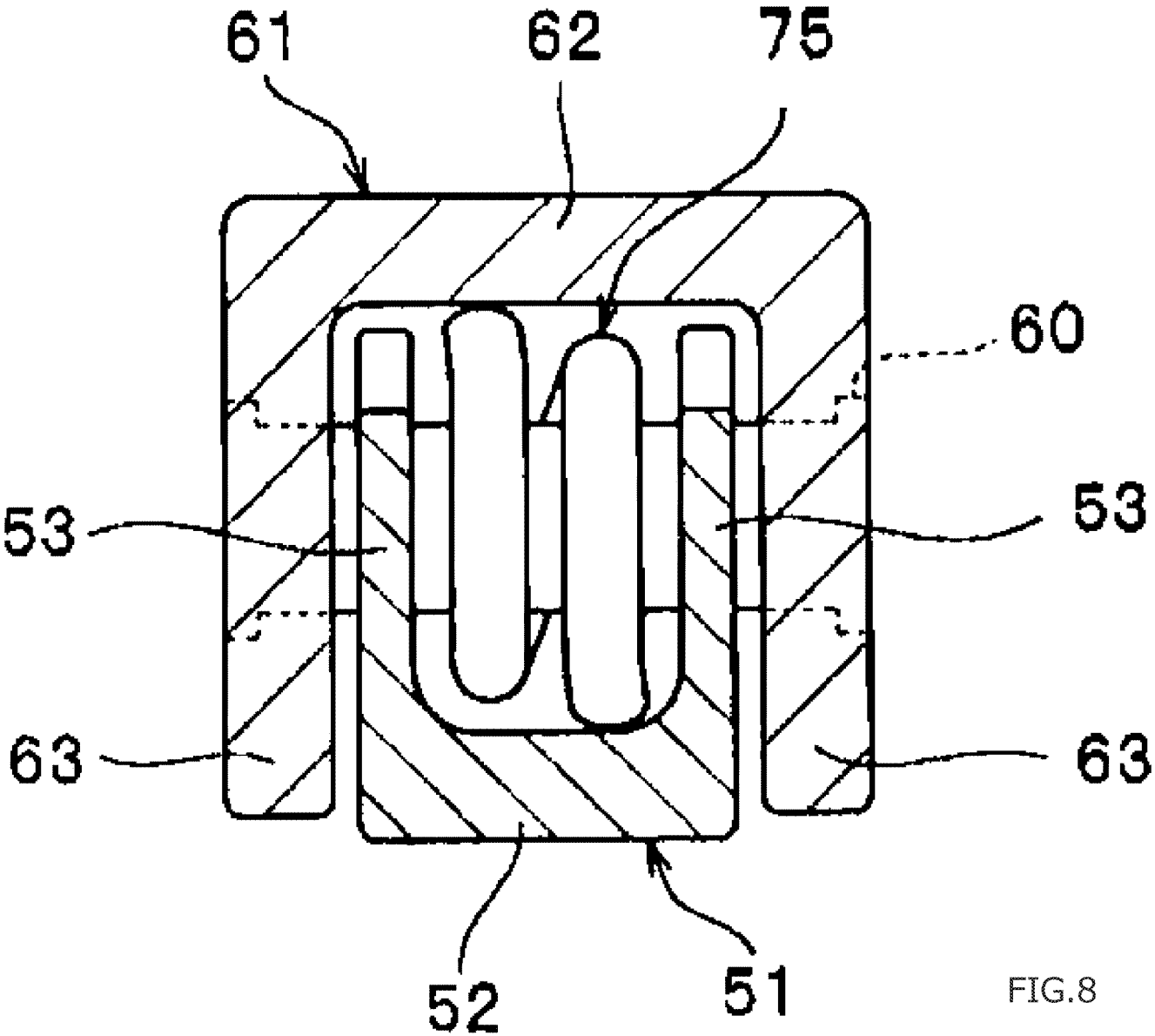
FIG. 8 A cross-sectional view taken along a line VIII-VIII shown in FIG. 5.

FIG. 5 and FIG. 6 are respectively a schematic side view and a schematic plan view of a fastening implement according to a second embodiment of the present invention. In addition, FIG. 7 and FIG. 8 are cross-sectional views respectively taken along a line VII-VII and a line VIII-VIII shown in FIG. 5.

A chain bracelet 2 according to the second embodiment includes a chain member 8 being the linear member, and a fastening implement 12 that is attached to both one end portion and another end portion of the chain member 8. The chain member 8 is formed of a cable chain obtained by coupling a plurality of metal rings 8*a* to each other.

The fastening implement 12 according to the second embodiment is made of a metal. This fastening implement 12 includes a first fastening member 50 that is attached to the one end portion of the chain member 8, and a second fastening member 70 that is attached to the other end portion of the chain member 8. The first fastening member 50 and the second fastening member 70 are separably coupled to each other. The first fastening member 50 according to the second embodiment is another example of the fastening member according to the present invention.

Components of the first fastening member 50 and the second fastening member 70 (except a torsional spring 75 described below) are each formed by punching or pressing of a metal plate. Note that, in the present invention, manufacturing methods, materials, and the like of the first fastening member 50 and the second fastening member 70 are not particularly limited, and may be selected in accordance with purpose.

The first fastening member 50 includes a base portion 51 that extends in the front-and-rear direction, a movable portion 61 that is supported to be capable of turning relative to the base portion 51 by a coupling shaft portion 60, and the torsional spring 75 that biases the movable portion 61. In this case, the base portion 51 is connected to the chain member 8. The movable portion 61 is turned to open and close the first fastening member 50. The movable portion 61 is capable of turning relative to the base portion 51 about the coupling shaft portion 60 along the width direction. As illustrated in FIG. 5, the movable portion 61 is capable of turning in a range from a closed position where a movable-side coupling portion 65 of the movable portion 61 comes into abutment against a base-side coupling portion 56 of the base portion 51 to a full-open position where an operating portion 64 of the movable portion 61 comes into abutment against a turning stop portion 54 of the base portion 51. The coupling shaft portion 60 is formed of a columnar member independent of the base portion 51 and the movable portion 61.

The base portion 51 includes a base-side body portion 52 that extends in the front-and-rear direction, base-side wall portions 59 and base-side support portions 53 that extend upward from lateral edge portions on both the sides in the right-and-left direction of the base-side body portion 52, and the base-side coupling portion 56 that extends to be curved into a fish-hook shape or a circular-arc shape from its position in the base-side body portion 52, which is away from the base-side support portions 53. In addition, the base portion 51 includes the turning stop portion 54 that extends from the base-side body portion 52 toward the chain member 8 along the front-and-rear direction, and a first chain-connecting portion 55 that extends further from the turning stop portion 54. A lower surface of the base-side body portion 52, a lower surface of the turning stop portion 54, and a lower surface of the first chain-connecting portion 55 form a single flat surface with no steps.

The base-side body portion 52 is formed into a thin plate shape that extends in the front-and-rear direction. Further, a dimension in the width direction of the base-side body portion 52 is uniform all over the front-and-rear direction (refer to FIG. 6).

The right-and-left base-side wall portions 59 are formed on an upper surface of the base-side body portion 52 along the front-and-rear direction. A space portion is formed between the right-and-left base-side wall portions 59. Thus, the base-side body portion 52 and the right-and-left base-side wall portions 59 exhibit a substantially U-shape in cross section orthogonal to the front-and-rear direction (refer to FIG. 7). With this, strength of the base portion 51 can be properly secured, and at the same time, weight and material cost of the base portion 51 can be reduced. Note that, the upper surface and the lower surface of the base-side body portion 52 are surfaces facing each other in the upper-and-lower direction. The upper surface of the base-side body portion 52 refers to a surface oriented to a side of the upper direction, and the lower surface of the base-side body portion 52 refers to a surface oriented to a side of the lower direction.

The right-and-left base-side wall portions 59 each include a continuous wall portion 59*a* that is formed continuously along the front-and-rear direction in a uniform height dimension, and an inclined wall portion 59*b* that is arranged at an end portion on a side where the base-side coupling portion 56 is arranged and that is gradually reduced in height dimension toward the base-side coupling portion 56. Note that, the height dimension of each of the base-side wall portions 59 refers to a dimension in the upper-and-lower direction from the upper surface of the base-side body portion 52 to an upper end surface of each of the base-side wall portions 59.

In the first fastening member 50 according to the second embodiment, the height dimension of each of the continuous wall portions 59*a* is 25% or more and 75% or less of a height dimension from the lower surface of the base-side body portion 52 to an upper surface of a movable-side body portion 62 described below of the movable portion 61 in the first fastening member 50 in the closed state. With this, the strength of the base portion 51 can be advantageously increased. The relationships between the height dimensions are not particularly limited, and the height dimension may be set, for example, to 40% or more and 60% or less. In addition, since the inclined wall portion 59*b* is arranged in each of the base-side wall portions 59, a second coupling portion 72 described below of the second fastening member 70 can be easily guided toward an inner peripheral portion of the base-side coupling portion 56.

The right-and-left base-side support portions 53 refer to parts each including an upper end portion that exhibits a circular-arc shape in the side view of the first fastening member 50. The base-side support portions 53 are provided parallel to the right-and-left base-side wall portions 59 at the end portion on the side in the front-and-rear direction of the base-side body portion 52, where the first chain-connecting portion 55 is provided. In this case, the base-side body portion 52 and the and the right-and-left base-side support portions 53 exhibit a substantially U-shape in cross-section orthogonal to the front-and-rear direction (refer to FIG. 8). A coil portion 76 described below of the torsional spring 75 is inserted between the right-and-left base-side support portions 53.

A height dimension of each of the base-side support portions 53 is larger than the height dimension of each of the continuous wall portions 59*a* of the base-side wall portions 59. Note that, the height dimension of each of the base-side support portions 53 refers to a dimension in the upper-and-lower direction from the upper surface of the base-side body portion 52 to a corresponding one of the upper end portions of the base-side support portions 53 each exhibiting the circular-arc shape in the side view. A thickness of each of the right-and-left base-side support portions 53 is substantially the same as a thickness of a corresponding one of the base-side wall portions 59. The thickness of each of the base-side support portions 53 and the thickness of each of the base-side wall portions 59 each refer to an interval between its inner wall surface and its outer wall surface. Attachment hole portions are formed in the right-and-left direction through the base-side support portions 53 on both right-and-left sides. The coupling shaft portion 60 is attached by being inserted into the right-and-left attachment hole portions.

The turning stop portion 54 of the base portion 51 extends in the front-and-rear direction continuously from the base-side body portion 52. As represented by a two-dot chain line in FIG. 5, by bringing the operating portion 64 of the movable portion 61 into abutment against the turning stop portion 54, the movable portion 61 is restricted from turning in its opening direction. Note that, a size of the torsional spring 75 may be set to be different from that illustrated in FIG. 5 so that the operating portion 64 is not directly brought into abutment against the turning stop portion 54. Specifically, in stopping the movable portion 61 from turning, apart of the torsional spring 75 may be inserted between the turning stop portion 54 and the operating portion 64 so that the operating portion 64 is indirectly brought into abutment against the turning stop portion 54.

This turning stop portion 54 includes a gradually expanded portion in which a dimension in the width direction is gradually increased to a side away from the base-side body portion 52, and a wide portion that extends continuously from the gradually expanded portion. A dimension in the width direction of the wide portion is uniform all over an entirety in the front-and-rear direction of the wide portion. With this, the turning stop portion 54 allows the operating portion 64 of the movable portion 61 to be stably brought into abutment against the turning stop portion 54 itself. In addition, right-and-left lateral cover portions 63 described below of the movable portion 61 can be prevented from coming into contact with the turning stop portion 54.

The first chain-connecting portion 55 extends in the front-and-rear direction from the turning stop portion 54 continuously and in a thin plate shape. A connection hole portion 55*a* is drilled in the upper-and-lower direction through the first chain-connecting portion 55. The connection hole portion 55*a* exhibits a circular shape in the plan view of the first fastening member 50. One of the metal rings 8*a*, which is arranged at the one end portion of the chain member 8, is inserted through the connection hole portion 55*a*. With this, the chain member 8 and the first chain-connecting portion 55 are connected to each other. Note that, in the present invention, a configuration of the first chain-connecting portion 55 and means for establishing the connection to the chain member 8 are not particularly limited.

The base-side coupling portion 56 is formed continuously from an end portion of the base-side body portion 52, which is on a side away from the first chain-connecting portion 55. The base-side coupling portion 56 is formed to be curved upward into the fish-hook shape or the circular-arc shape from the end portion of the base-side body portion 52. In the side view of the first fastening member 50, an inner space portion 57 is formed on an inner peripheral side of the base-side coupling portion 56. A thickness and a dimension in the width direction of the base-side coupling portion 56 are substantially the same as a thickness and the dimension in the width direction of the base-side body portion 52, respectively.

Between a distal end of the base-side coupling portion 56 and the lateral cover portions 63 of the movable portion 61, an insertion-and-removal opening portion through which the second coupling portion 72 of the second fastening member 70 can pass is provided. This insertion-and-removal opening portion refers to a space part or an opening part to be formed on an imaginary straight line between the base-side coupling portion 56 and the lateral cover portions 63 in the side view of the first fastening member 50, the imaginary straight line being extended parallel to the front-and-rear direction from the distal end of the base-side coupling portion 56 toward the lateral cover portions 63. In the side view of the first fastening member 50, a size in the front-and-rear direction of the insertion-and-removal opening portion varies in accordance with turning angle of the movable portion 61 relative to the base portion 51.

The inner space portion 57 of the first fastening member 50 is provided on the inner peripheral side of the base-side coupling portion 56. This inner space portion 57 is arranged on a lower side in the upper-and-lower direction relative to an opening position along the front-and-rear direction of the insertion-and-removal opening portion. The inner space portion 57 and the insertion-and-removal opening portion communicate with each other. In addition, when the first fastening member 50 is opened, the insertion-and-removal opening portion is uncovered upward as an insertion port into which the second coupling portion 72 of the second fastening member 70 is inserted, or as a removal port through which the second coupling portion 72 is removed. With this, a space on an outside of the first fastening member 20 and the insertion-and-removal opening portion of the first fastening member 50 communicate with each other.

The movable portion 61 according to the second embodiment includes the movable-side body portion 62 that extends in the front-and-rear direction under the state in which the movable portion 61 is held at the closed position, and the right-and-left lateral cover portions 63 that are provided on both right-and-left sides of the movable-side body portion 62 and that extend from the movable-side body portion 62 toward the base portion 51. At an end portion in the front-and-rear direction of the movable-side body portion 62, which is on the side close to the first chain-connecting portion 55, the operating portion 64 is provided to extend in a direction bent obliquely upward from the movable-side body portion 62. From another end portion in the front-and-rear direction of the movable-side body portion 62, which is on the side away from the first chain-connecting portion 55, the movable-side coupling portion 65 extends to be curved into a fish-hook shape or a circular-arc shape.

The movable-side body portion 62 refers to a plate-like member that is arranged parallel to the base-side body portion 52 under the state in which the movable portion 61 is held at the closed position. A dimension in the width direction of the movable-side body portion 62 is uniform and larger than the dimension in the width direction of the base-side body portion 52.

The right-and-left lateral cover portions 63 are provided along right-and-left lateral edge portions of the movable-side body portion 62. The movable-side body portion 62 and the right-and-left lateral cover portions 63 exhibit a substantially inverted U-shape in cross-section orthogonal to the front-and-rear direction. Between inner wall surfaces of the right-and-left lateral cover portions 63, which face each other, a space portion into which the base-side body portion 52, the right-and-left base-side wall portions 59, and the right-and-left base-side support portions 53 of the base portion 51 can be inserted is provided. An interval in the width direction in this space portion is larger than an interval between the outer wall surfaces of the right-and-left base-side wall portions 59 of the base portion 51.

Between the lateral cover portions 63 of the movable portion 61 and the base-side wall portions 59 of the base portion 51, small clearances for preventing the movable portion 61 and the base portion 51 from coming into contact with each other are secured. In addition, in the side view of the first fastening member 50 in the closed state, a straight lower edge of each of the lateral cover portions 63 is arranged at the same position as a height position of the lower surface of the base-side body portion 52, or a position slightly above the height position of the lower surface. With this, the base-side body portion 52, the right-and-left base-side wall portions 59, and the right-and-left base-side support portions 53 of the base portion 51 can be covered from the outside with the movable portion 61. Thus, an appearance of the first fastening member 50 can be enhanced, whereby quality of an external appearance of the fastening implement 12 can be enhanced.

In the side view of the first fastening member 50 in the closed state, the right-and-left lateral cover portions 63 include at least regions that are superimposed on the right-and-left base-side support portions 53. Attachment hole portions for allowing the coupling shaft portion 60 to be attached are formed through the right-and-left lateral cover portions 63.

The operating portion 64 of the movable portion 61 is formed into a shape of a protruding piece that protrudes to be bent upward from the one end portion of the movable-side body portion 62. The movable portion 61 is capable of turning in a range from the closed position of the movable portion 61 to a turning limit position in the opening direction, where the operating portion 64 comes into contact with the turning stop portion 54 of the base portion 51. In this case, the turning limit position where the operating portion 64 comes into contact with the turning stop portion 54 corresponds to the full-open position of the first fastening member 50. As illustrated in FIG. 5, the range where the movable portion 61 turns from the closed position to the full-open position refers to a turnable range θ2. The operating portion 64 is provided so that the turnable range θ2 in the fastening member 2 illustrated in FIG. 5 is 30° or more and 60° or less.

Note that, in the present invention, the turnable range θ2 of the movable portion 61 is not particularly limited. For example, a lower limit of the turnable range θ2 may be 30° or more, or may be 40° or more. An upper limit of the turnable range θ2 may be 60° or less, or may be 50° or less. When the turnable range θ2 falls within this range, ease of turning the movable portion 61 is further likely to be increased. In addition, ease of coupling and ease of separation of the fastening implement 12 are further likely to be increased.

Under the state in which the movable portion 61 is biased by the torsional spring 75, when the operating portion 64 is used to turn the movable portion 61 against biasing force of the torsional spring 75, an operation to turn the movable portion 61 is facilitated. Further, by bringing the operating portion 64 into abutment against the turning stop portion 54 of the base portion 51, the movable portion 61 can be stably maintained at the full-open position.

Still further, in consideration of the quality of the external appearance of the fastening implement 12, the operating portion 64 according to the second embodiment is formed to have a dimension in the width direction, which is smaller than that of the movable-side body portion 62. Note that, in the present invention, the operating portion 64 is not particularly limited in shape or size. For example, the operating portion 64 may be formed into a fan shape, a heart shape, or a star shape so as to enhance a design feature. In addition, the width dimension of the operating portion 64 may be increased so that ease of operating the movable portion 61 is increased.

The movable-side coupling portion 65 has a uniform thickness. The distal end portion of the movable-side coupling portion 65 includes a part where its dimension in the width direction is gradually reduced toward the distal end portion. With this, the movable-side coupling portion 65 is easily inserted into an insertion hole portion 72*a* of the second fastening member 70.

Under the state in which the movable portion 61 is held at the closed position, the movable-side coupling portion 65 extends to a lower side relative to a height position at half of a height dimension of an entirety of the first fastening member 50. This movable-side coupling portion 65 may extend to a lower side relative to a height position of the upper surface of the base-side body portion 52. In addition, in the side view of the first fastening member 50 at the closed position, at least apart of an inner peripheral portion of the movable-side coupling portion 65 comes into abutment against an outer peripheral portion of the base-side coupling portion 56. Even under the state in which the movable-side coupling portion 65 is held in abutment against the base-side coupling portion 56, the movable portion 61 is biased by the torsional spring 75 attached to the coupling shaft portion 60 into a direction in which the movable-side coupling portion 65 is pressed against the base-side coupling portion 56.

Note that, although the inner peripheral portion of the movable-side coupling portion 65 comes into abutment against the outer peripheral portion of the base-side coupling portion 56 of the base portion 51 at the closed position in the second embodiment, the present invention is not limited thereto. For example, at the closed position, the inner peripheral portion of the movable-side coupling portion 65 and the outer peripheral portion of the base-side coupling portion 56 need not necessarily be held in abutment against each other, and a small gap may be secured therebetween so that these peripheral portions face each other. In addition, in the first fastening members according to the present invention, for example, the outer peripheral portion of the movable-side coupling portion may be held in contact with or face the inner peripheral portion of the base-side coupling portion.

Figure 9:
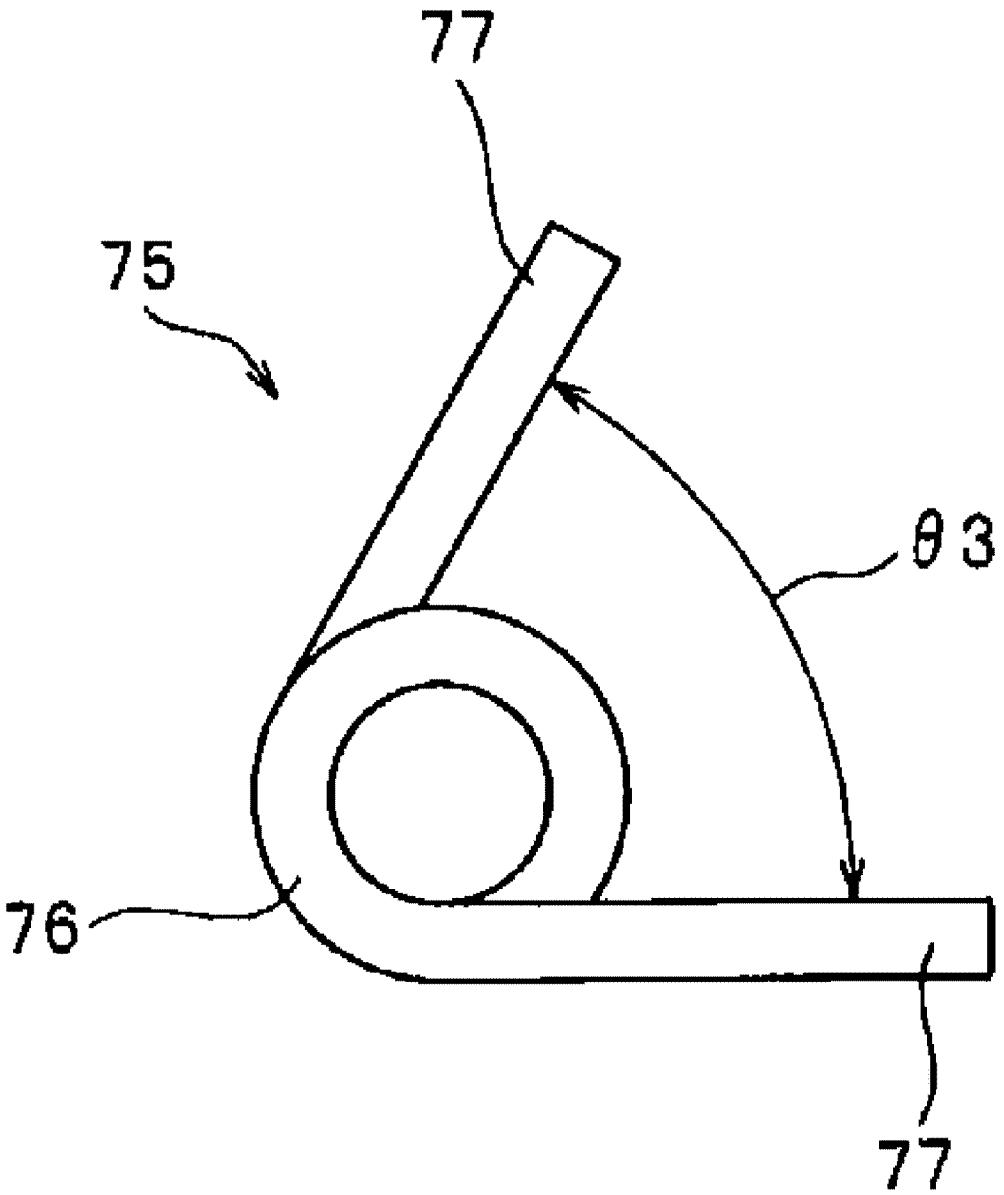
FIG. 9 A schematic view of a torsional spring to be arranged in the fastening implement illustrated in FIG. 5.

The torsional spring 75 that is attached to the first fastening member 50 includes the coil portion 76 formed by winding a wire into a coil shape, and two arm portions 77 that extend respectively from two end portions of the coil portion 76 (refer to FIG. 9). This torsional spring 75 is wound around the coupling shaft portion 60 that serves as a rotary shaft of the movable portion 61.

The torsional spring 75 according to the second embodiment is formed by winding a metal wire into the coil shape. For example, when the number of effective windings of the coil portion 76 is one, a size in the width direction of the coil portion 76 can be reduced. As a result, the torsional spring 75 can be easily accommodated within the limited space between the right-and-left base-side wall portions 59 of the base portion 51.

In a side view of the torsional spring 75, an arm angle θ3 is formed between the two arm portions 77 of the torsional spring 75. The arm angle θ3 of the torsional spring 75 before being attached to the first fastening member 50 is higher than an angle between the turning stop portion 54 of the base portion 51 and the operating portion 64 of the movable portion 61 at the closed position. With this, under the state in which the first fastening member 50 is closed, the torsional spring 75 can stably bias the movable portion 61 into the direction in which the movable-side coupling portion 65 is pressed against the base-side coupling portion 56 of the base portion 51.

Note that, in the present invention, the number of the effective windings of the coil portion 76 of the torsional spring 75 is not particularly limited. From a viewpoint of ease of the accommodation between the right-and-left base-side wall portions 59, and a viewpoint of the biasing force by which the movable portion 61 is biased, it is appropriate to set a diameter of the wire forming the torsional spring 75 and the number of the effective windings of the coil portion 76 of the torsional spring 75 in accordance with purpose. For example, the number of the effective windings of the coil portion 76 may be one or more, or may be two or more. The number of the effective windings of the coil portion 76 may be ten or less, or may be five or less. Further, the movable portion 61 may be biased by another elastic member than the torsional spring 75 described in the second embodiment. The elastic member need not necessarily be the torsional spring, and may be other spring members such as a leaf-spring member. Still further, for example, synthetic rubber having a shape in accordance with purpose may be used as the elastic member so as to bias the movable portion 61.

The torsional spring 75 is attached to the coupling shaft portion 60 in a columnar shape. The coupling shaft portion 60 is inserted through the coil portion 76 of the torsional spring 75. Flange portions are provided respectively to right-and-left end portions of the coupling shaft portion 60. The right-and-left flange portions are formed by pressing both the right-and-left end portions of the coupling shaft portion 60 toward an inside in the width direction. In the side view of the first fastening member 50, the right-and-left flange portions exhibits, for example, a circular shape having a diameter larger than that of the coupling shaft portion 60. The right-and-left flange portions prevent the coupling shaft portion 60 from dropping off the first fastening member 50.

The second fastening member 70 is formed into a thin plate shape. This second fastening member 70 includes a second connecting portion 71 to which the other end portion of the chain member 8 is coupled and connected, and the second coupling portion 72 that is formed integrally with the second connecting portion 71. A boundary portion between the second connecting portion 71 and the second coupling portion 72 corresponds to an intermediate portion in the front-and-rear direction of the second fastening member 70.

A second connecting-hole portion 71*a* is drilled in the upper-and-lower direction through the second connecting portion 71 of the second fastening member 70. The second connecting-hole portion 71*a* exhibits a circular shape in the plan view of the second fastening member 70. Another one of the metal rings 8*a*, which is arranged at the other end of the chain member 8, is inserted through the second connecting-hole portion 71*a*. With this, the chain member 8 and the second connecting portion 71 are connected to each other.

The second coupling portion 72 corresponds to the coupling subject portion to which the first fastening member 50 is coupled. The insertion hole portion 72*a* is drilled in the upper-and-lower direction through the second coupling portion 72. The insertion hole portion 72*a* exhibits a circular shape in the plan view of the second fastening member 70. The insertion hole portion 72*a* is opened to have a size in which the base-side coupling portion 56 and the movable-side coupling portion 65 of the first fastening member 50 can be inserted at once through the insertion hole portion 72*a* itself. In coupling the first fastening member 50 and the second fastening member 70 to each other, a part of the second coupling portion 72 is hooked to and held by the base-side coupling portion 56 of the first fastening member 50. Note that, in the present invention, the insertion hole portion 72*a* that is provided through the second coupling portion 72 is not particularly limited in shape.

In the first fastening member 50 according to the second embodiment, since the movable portion 61 is biased by the torsional spring 75, the inner peripheral portion of the movable-side coupling portion 65 and the outer peripheral portion of the base-side coupling portion 56 are held at the closed position of the movable portion 61, where these peripheral portions are held in abutment against each other.

Under the state in which the movable portion 61 of the first fastening member 50 is held at the closed position, for example, the operating portion 64 of the movable portion 61 and the base portion 51 are pinched with fingers from above and below. Then, the operating portion 64 is pushed with the fingers in a direction toward the turning stop portion 54. With this, the movable portion 61 is easily turned clockwise in FIG. 5 about the coupling shaft portion 60 against the biasing force of the torsional spring 75.

Figure 10:
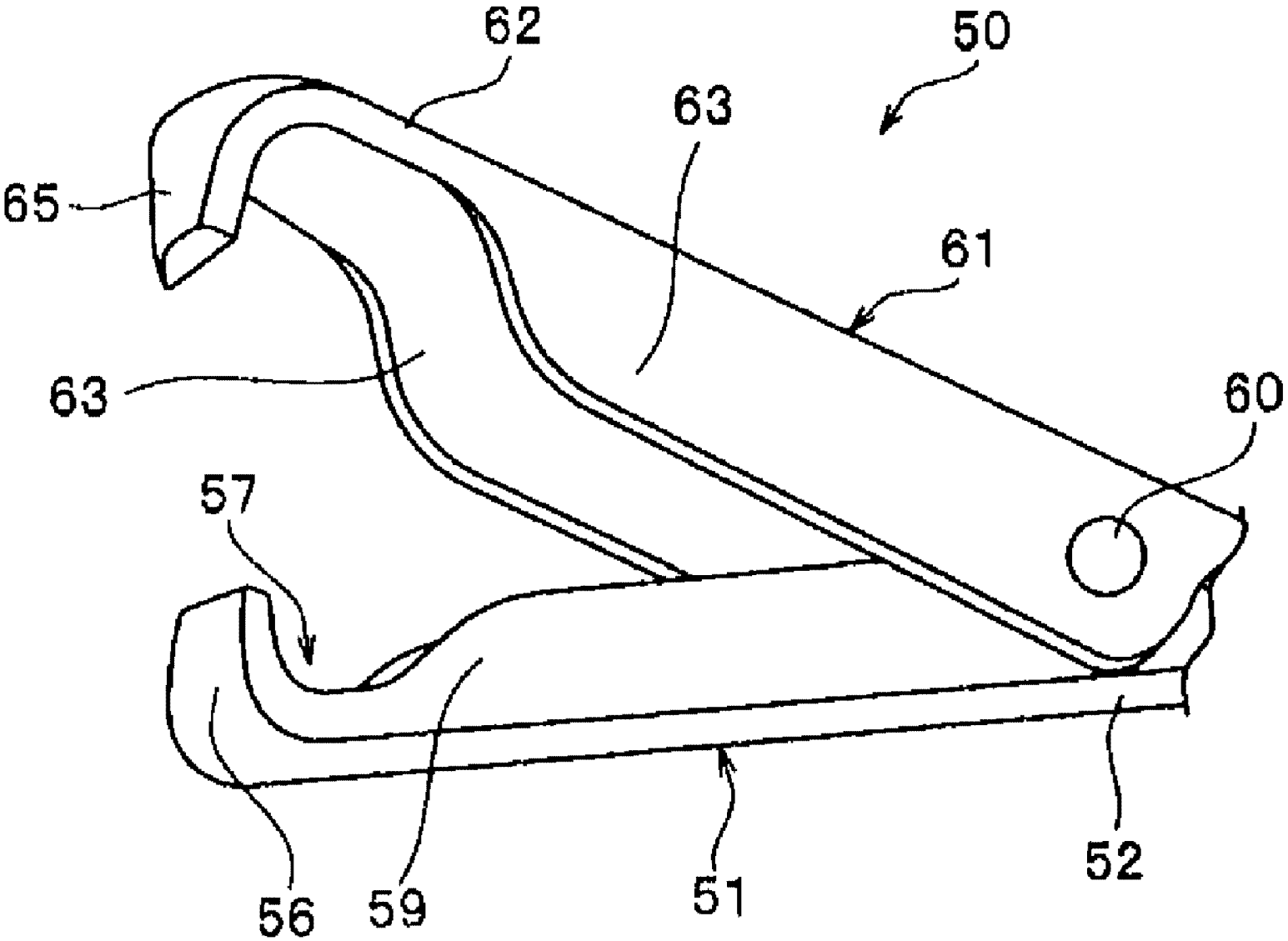
FIG. 10 A schematic perspective view illustrating a state in which a first fastening member of the fastening implement illustrated in FIG. 5 is opened.

In addition, when the operating portion 64 of the movable portion 61 being turned is brought into abutment against the turning stop portion 54 of the base portion 51, the movable portion 61 is stopped from turning. With this, the movable portion 61 is held at the full-open position, and the first fastening member 50 is opened (refer to FIG. 10).

Then, by releasing the operating portion 64 of the movable portion 61 held at the full-open position from the fingers, the movable portion 61 is automatically turned to the closed position by the biasing force of the torsional spring 75. With this, the first fastening member 50 is closed.

The first fastening member 50 according to the second embodiment allows the operations to open and close the first fastening member 50 to be easily performed with one hand. With this, the operation to couple the first fastening member 50 and the second fastening member 70 to each other and the operation to separate these members from each other can be easily and smoothly performed only with one hand. Thus, ease of the operations in opening and closing the first fastening member 50, and ease of the series of operations in coupling and separating the fastening implement 12 are excellent.

Further, when the first fastening member 50 and the second fastening member 70 are coupled to each other, the base-side coupling portion 56 and the movable-side coupling portion 65 are inserted through the insertion hole portion 72*a* of the second fastening member 70 with the inner peripheral portion of the movable-side coupling portion 65 held in contact with the outer peripheral portion of the base-side coupling portion 56. Thus, the state in which the first fastening member 50 and the second fastening member 70 are coupled to each other can be stably maintained. In addition, tensile strength that the fastening implement 12 exhibits, for example, under a state in which the first fastening member 50 and the second fastening member 70 are pulled in directions away from each other can be increased.

In the second embodiment, by utilizing the biasing force of the torsional spring 75, the state in which the first fastening member 50 is closed can be maintained. Thus, even when the operations to couple and separate the fastening implement 12 are repeatedly performed, temporal deformation and metal fatigue of the base-side coupling portion 56 of the base portion 51 and the movable-side coupling portion 65 of the movable portion 61 can be prevented.

Still further, the arm angle θ3 of the torsional spring 75 is set in the appropriate range. In this case, by restricting a range of elastic deformation of the torsional spring 75 to an appropriate range, even when the operations to open and close the first fastening member 50 are repeated, the first fastening member 50 can be stably used over a long time period. Specifically, the range of the elastic deformation of the torsional spring 75 can be restricted by bringing the operating portion 64 and the turning stop portion 54 of the base portion 51 of the first fastening member 50 into contact with each other. With this, damage to the torsional spring 75 is further prevented.

Third Embodiment

Figure 11:
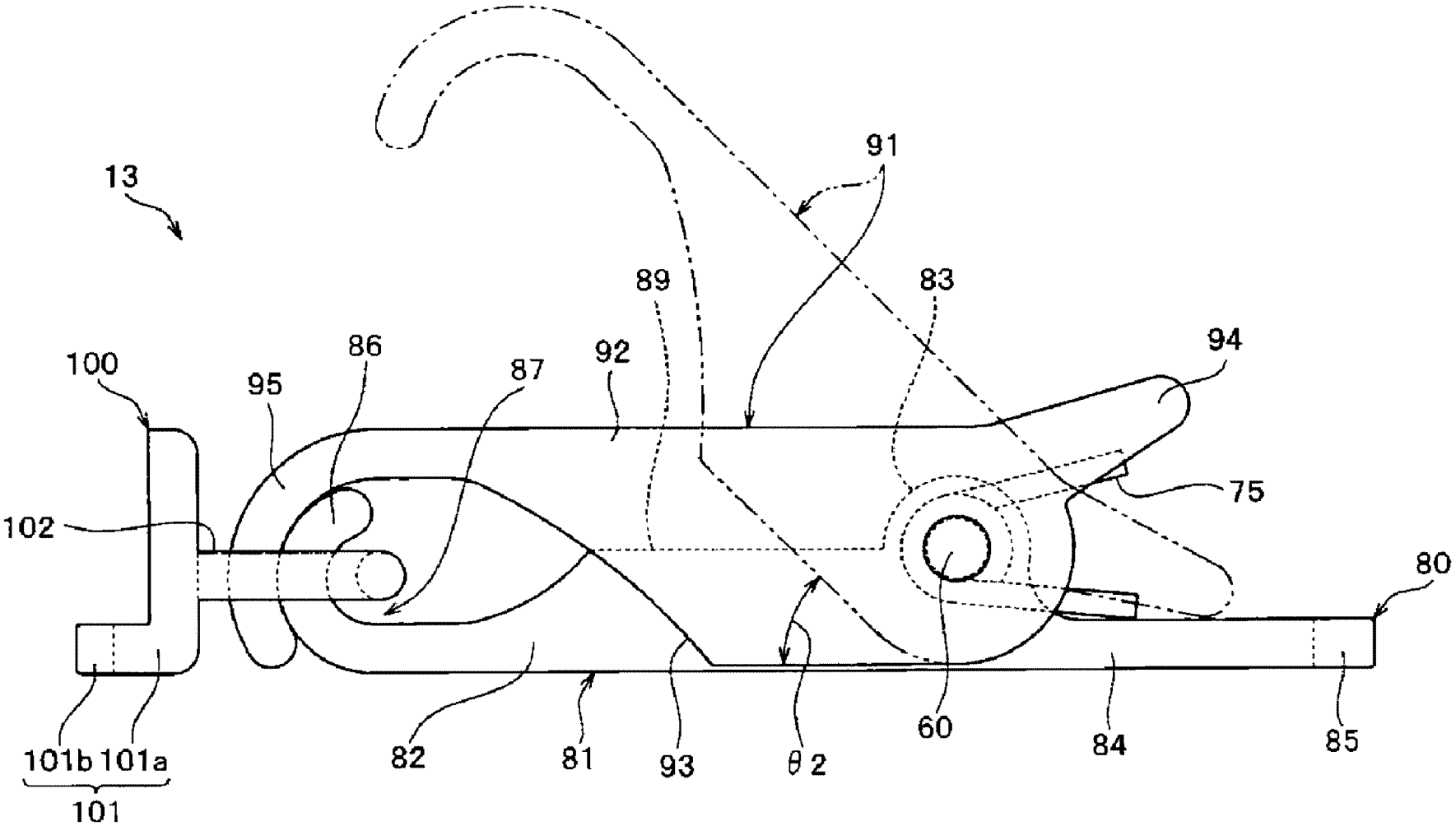
FIG. 11 A schematic side view of a fastening implement to be used in a third embodiment of the present invention.
Figure 12:
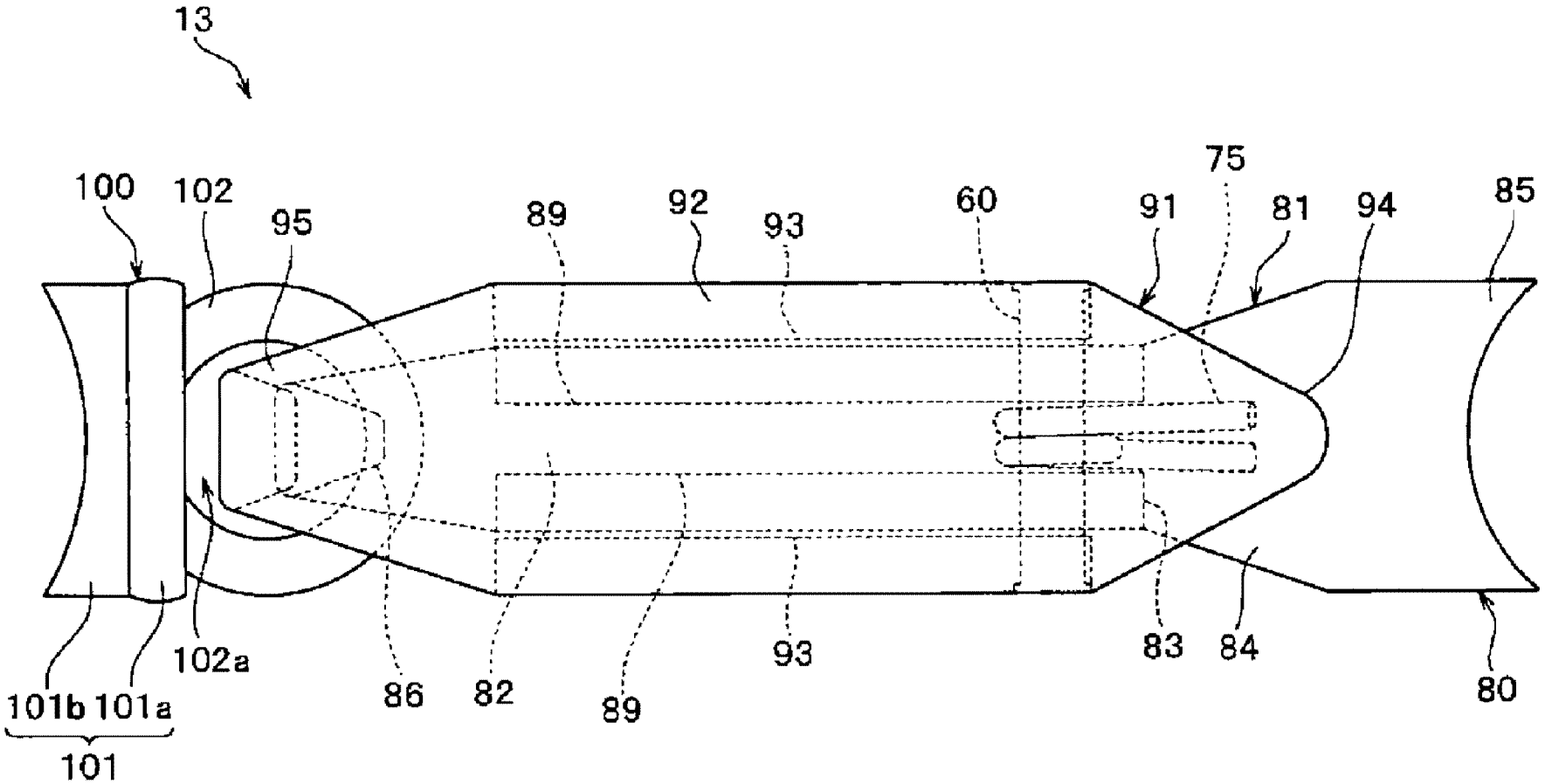
FIG. 12 A plan view of the fastening implement illustrated in FIG. 11.

FIG. 11 and FIG. 12 are respectively a schematic side view and a plan view of a fastening implement according to a third embodiment of the present invention.

A fastening implement 13 according to the third embodiment is attached to both one end portion and another end portion of a chain member (not shown) of a tennis bracelet. This fastening implement 13 includes a first fastening member 80 that is made of a metal and that is attached to the one end portion of the chain member, and a second fastening member 100 that is made of a metal and that is attached to the other end portion of the chain member. The first fastening member 80 according to the third embodiment is a still another example of the fastening member according to the present invention.

Although the first fastening member 80 according to the third embodiment is different from the first fastening member 50 according to the second embodiment, for example, in size of sections and parts, the first fastening member 80 according to the third embodiment is formed to have substantially the same structure and substantially the same configuration as those of the first fastening member 50 according to the second embodiment. Below, main sections and parts of the first fastening member 80 according to the third embodiment are described.

The first fastening member 80 according to the third embodiment includes a base portion 81 that is fixed to the chain member, a movable portion 91 that is supported to be capable of turning relative to the base portion 81 by a coupling shaft portion 60, and the torsional spring 75 that biases the movable portion 91. The movable portion 91 is attached to be capable of turning relative to the base portion 81. The movable portion 91 is capable of turning in a range from a closed position where the movable portion 91 comes into abutment against a base-side coupling portion 86 and the first fastening member 80 is closed to a full-open position where the movable portion 91 comes into abutment against a turning stop portion 84 of a base portion 81. The first fastening member 80 is opened and closed by turning the movable portion 91. The coupling shaft portion 60 is formed of a member independent of the base portion 81 and the movable portion 91.

The base portion 81 includes a plate-like base-side body portion 82 that extends in the front-and-rear direction, base-side wall portions 89 and base-side support portions 83 that extend upward from lateral edge portions on both sides in the right-and-left direction of the base-side body portion 82, and the base-side coupling portion 86 that extends to be curved into a fish-hook shape or a circular-arc shape from the base-side body portion 82. In addition, the base portion 81 includes the turning stop portion 84 that extends from the base-side body portion 82, and a first chain-connecting portion 85 that extends further from the turning stop portion 84.

A thickness of the base-side body portion 82 is uniform all over the front-and-rear direction. The base-side body portion 82 includes a wide portion in which a dimension in the width direction is uniform, and a gradually tapered portion in which the dimension in the width direction is gradually reduced toward the base-side coupling portion 86 (refer to FIG. 12). The base-side wall portions 89 on both right-and-left sides are provided as right-and-left lateral edge portions of the wide portion of the base-side body portion 82 along the front-and-rear direction. A space portion is formed between the right-and-left base-side wall portions 89.

The right-and-left base-side support portions 83 refer to parts each including an upper end portion that exhibits a circular-arc shape in the side view of the first fastening member 80. The right-and-left base-side support portions 83 are arranged at an end portion in the front-and-rear direction of the base-side body portion 82, which is on a side close to the first chain-connecting portion 85. In addition, the right-and-left base-side support portions 83 are formed parallel to and integrally with the right-and-left base-side wall portions 89, respectively. Attachment hole portions that allow the coupling shaft portion 60 to be attached are formed through the right-and-left base-side support portions 83. The coil portion 76 of the torsional spring 75 is inserted between the right-and-left base-side support portions 83.

The turning stop portion 84 of the base portion 81 extends in the front-and-rear direction from the base-side body portion 82. The turning stop portion 84 allows an operating portion 94 of the movable portion 91 to directly brought into abutment against the turning stop portion 84 itself. Note that, the operating portion 94 need not necessarily be directly brought into abutment against the turning stop portion 84, and the part of the torsional spring 75 may be inserted between the turning stop portion 84 and the operating portion 94 so that the operating portion 94 is indirectly brought into abutment against the turning stop portion 54. The turning stop portion 84 has a shape in which the dimension in the width direction is gradually increased toward a side away from the base-side body portion 82.

The first chain-connecting portion 85 extends in the front-and-rear direction continuously from the turning stop portion 84. A distal end portion of this first chain-connecting portion 85 is formed in conformity with a shape of the one end portion of the chain member (not shown). By fixing the first chain-connecting portion 85 to the chain member, the first chain-connecting portion 85 is connected to the chain member.

The base-side coupling portion 86 is formed to be curved upward into the fish-hook shape or the circular-arc shape from another end portion on another side of the base-side body portion 82, which is away from the first chain-connecting portion 85. A thickness of this base-side coupling portion 86 is substantially the same as that of the base-side body portion 82. A dimension in the width direction of the base-side coupling portion 86 is gradually and continuously reduced from the gradually tapered portion of the base-side body portion 82 toward a distal end of the base-side coupling portion 86. With this, the base-side coupling portion 86 is easily inserted into an insertion hole portion 102*a* of the second fastening member 100. An inner space portion 87 is formed on an inner peripheral side of the base-side coupling portion 86.

This inner space portion 87 communicates with an insertion-and-removal opening portion to be formed from the distal end portion of the base-side coupling portion 86 toward the movable portion 91 along the front-and-rear direction when the first fastening member 80 is opened. Note that, the insertion-and-removal opening portion according to the third embodiment refers to a space part or an opening part to be formed on an imaginary straight line between the base-side coupling portion 86 and the lateral cover portions 93 in the side view of the first fastening member 80, the imaginary straight line being extended parallel to the front-and-rear direction from the distal end of the base-side coupling portion 86 toward the lateral cover portions 93.

The movable portion 91 according to the third embodiment includes a plate-like movable-side body portion 92 that extends in the front-and-rear direction under the state in which the movable portion 91 is held at the closed position, and right-and-left lateral cover portions 93 that are provided on both right-and-left sides of the movable-side body portion 92 and that extend downward from the movable-side body portion 92 toward the base portion 81. At an end portion in the front-and-rear direction of the movable-side body portion 82, which is on the side close to the first chain-connecting portion 85, the operating portion 94 is provided to extend in a direction bent obliquely upward from the movable-side body portion 82. At another end portion in the front-and-rear direction of the movable-side body portion 92, which is on the side away from the first chain-connecting portion 85, a movable-side coupling portion 95 extends to be curved into a fish-hook shape or a circular-arc shape. The movable-side body portion 92 includes a wide portion in which a dimension in the width direction is uniform and larger than that of the base-side body portion 82, and a gradually tapered portion in which the dimension in the width direction is gradually reduced from the wide portion toward the movable-side coupling portion 95 (refer to FIG. 12).

The right-and-left lateral cover portions 93 extend downward from right-and-left lateral edge portions of the wide portion of the movable-side body portion 92. A space portion is provided between the right-and-left lateral cover portions 93. An interval in the width direction in this space portion is larger than an interval between outer wall surfaces of the right-and-left base-side wall portions 89 of the base portion 81. The right-and-left lateral cover portions 93 are formed to include at least regions to be superimposed on the base-side support portions 83 in the side view of the first fastening member 80. In these regions to be superimposed on the base-side support portions 83, the attachment hole portions that allow the coupling shaft portion 60 to be attached are formed.

The operating portion 94 according to the third embodiment is provided so that the turnable range θ2 of the movable portion 91 is 30° or more and 60° or less. The turnable range θ2 of the movable portion 91 is not particularly limited. For example, the lower limit of the turnable range θ2 may be 30° or more, or may be 40° or more. The upper limit of the turnable range θ2 may be 60° or less, or may be 50° or less.

A thickness of the movable-side coupling portion 95 is uniform. A dimension in the width direction of the movable-side coupling portion 95 is gradually and continuously reduced from the gradually tapered portion of the movable-side body portion 92 toward a distal end portion of the movable-side coupling portion 95. Under the state in which the first fastening member 80 is closed, the movable-side coupling portion 95 extends to a lower side relative to a height position of an upper surface of the base-side body portion 82.

In the side view of the first fastening member 80, at least a part of an inner peripheral portion of the movable-side coupling portion 95 comes into abutment against an outer peripheral portion of the base-side coupling portion 86. Even under the state in which the movable-side coupling portion 95 is held in abutment against the base-side coupling portion 86, the movable portion 91 is biased by the torsional spring 75 into a direction in which the movable-side coupling portion 95 is pressed against the base-side coupling portion 86.

The torsional spring 75 and the coupling shaft portion 60 according to the third embodiment are formed to be substantially the same as the torsional spring 75 and the coupling shaft portion 60 according to the second embodiment, respectively. Thus, in the third embodiment, the torsional spring 75 and the coupling shaft portion 60 are denoted by the same reference numerals as those in the foregoing second embodiment to omit redundant description thereof.

The second fastening member 100 according to the third embodiment includes a second connecting portion 101 to which the other end portion of the chain member is coupled by being fixed, and a second coupling ring 102 that is formed integrally with the second connecting portion 101. The second connecting portion 101 includes a second connecting-body portion 101*a* having a height dimension corresponding to that of the first fastening member 80, and a second connecting-piece portion 101*b* that extends from a lower end portion of the second connecting-body portion 101*a* toward one side in the front-and-rear direction. A distal end portion of the second connecting-piece portion 101*b* has a shape conforming to a shape of the other end portion of the chain member.

The insertion hole portion 102*a* is provided through the second coupling ring 102 in the upper-and-lower direction. The insertion hole portion 102*a* of the second coupling ring 102 is opened to have a size in which both the base-side coupling portion 86 and the movable-side coupling portion 95 of the first fastening member 80 can be inserted at once through the insertion hole portion 102*a*. This second coupling ring 102 corresponds to the coupling subject portion to which the first fastening member 80 is coupled.

Although the first fastening member 80 according to the third embodiment is different from the first fastening member 50 according to the foregoing second embodiment, for example, in dimensional proportion and partial shape of the sections, the first fastening member 80 according to the third embodiment allows the operations to open and close the first fastening member 80 to be easily performed only with one hand similar to the first fastening member 50 according to the second embodiment. With this, the operations to couple and separate the fastening implement 13 can be easily and smoothly performed only with one hand. Thus, the first fastening member 80 and the fastening implement 13 according to the third embodiment provide advantages similar to those of the first fastening member 50 and the fastening implement 12 according to the second embodiment. In other words, the fastening implement 12 according to the second embodiment and the fastening implement 13 according to the third embodiment may each be formed into various sizes and shapes in accordance with, for example, type of the accessory and its design without changing essential structures.

Fourth Embodiment

Figure 13:
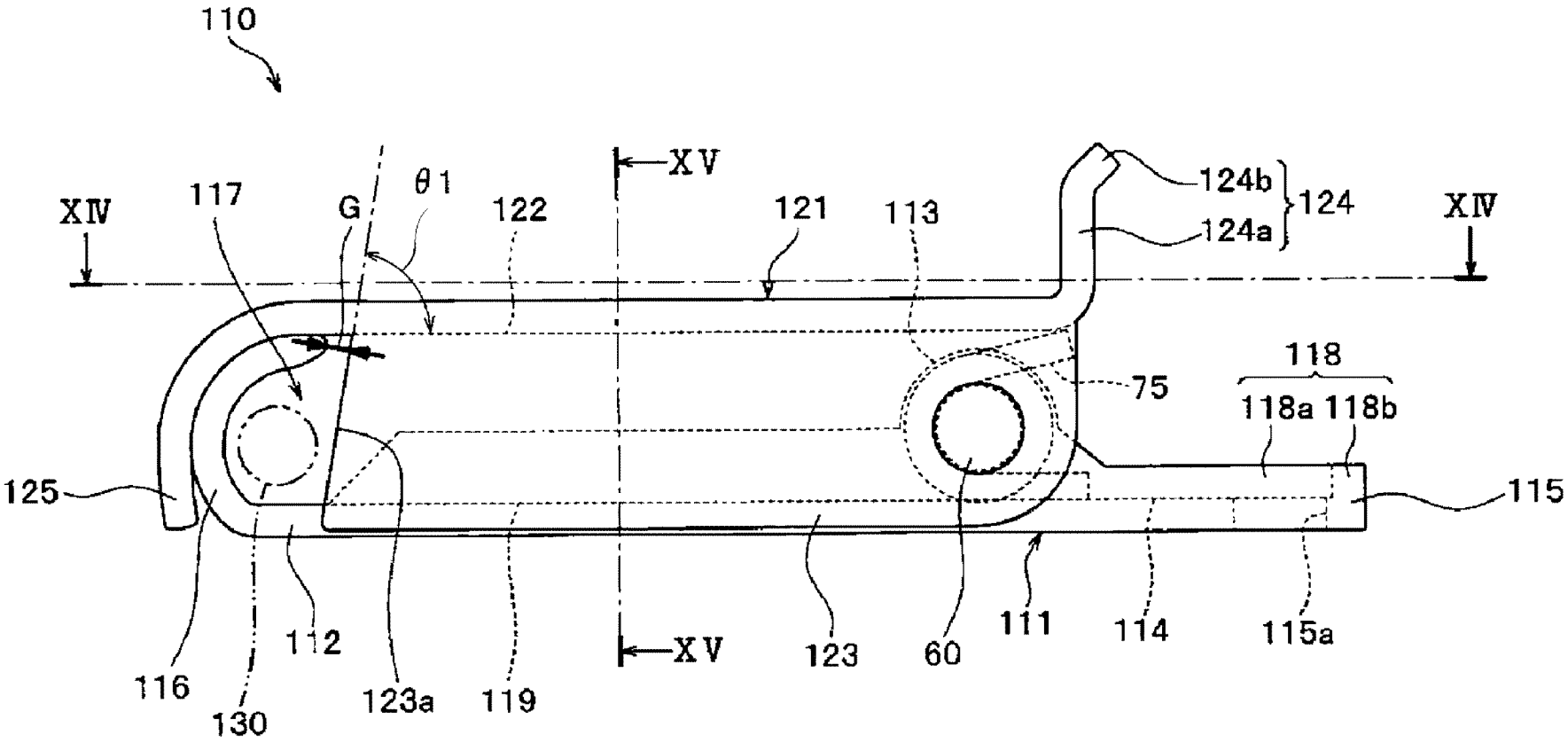
FIG. 13 A schematic side view of a fastening implement to be used in a fourth embodiment of the present invention.
Figure 14:
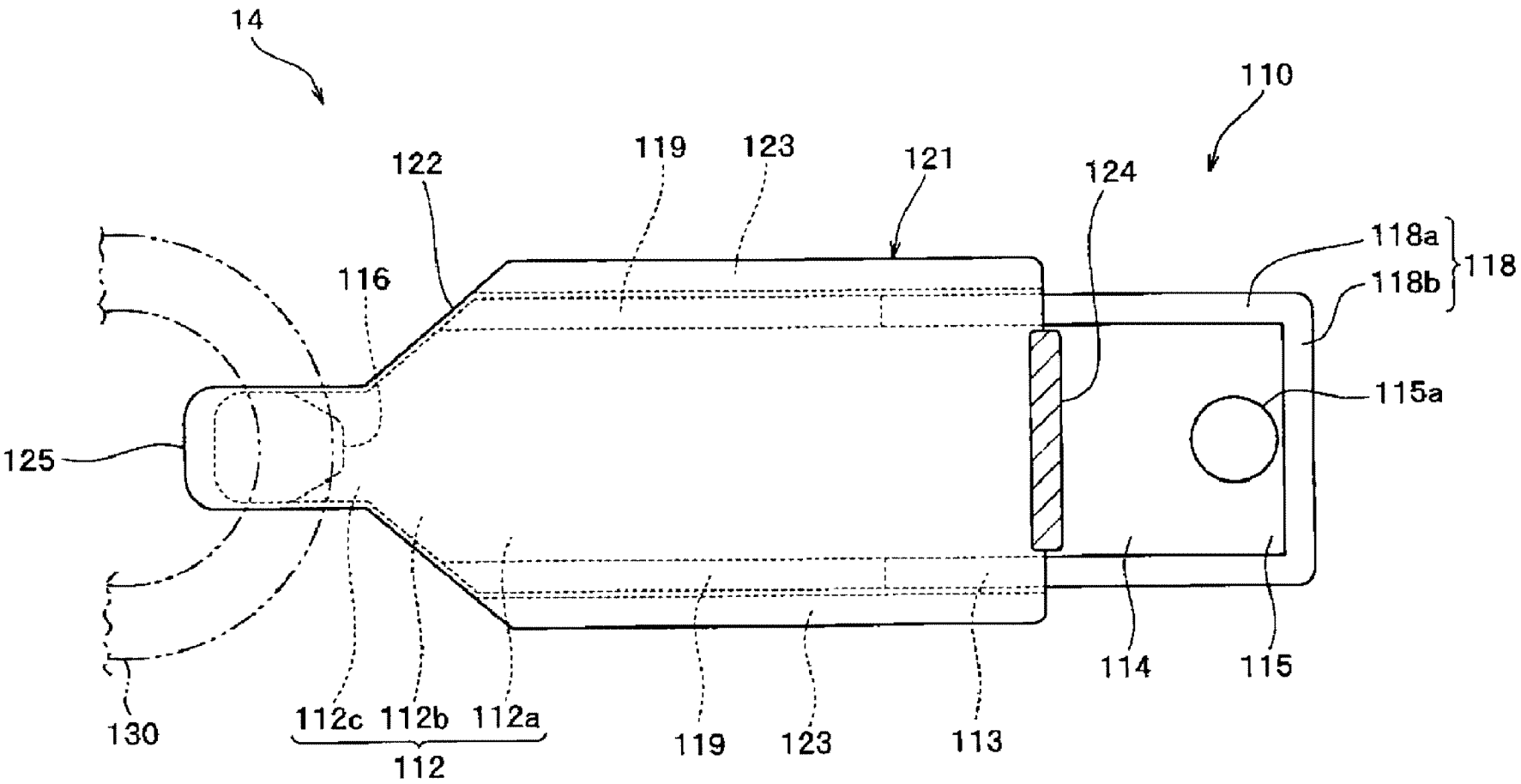
FIG. 14 A cross-sectional view taken along a line XIV-XIV shown in FIG. 13.
Figure 15:
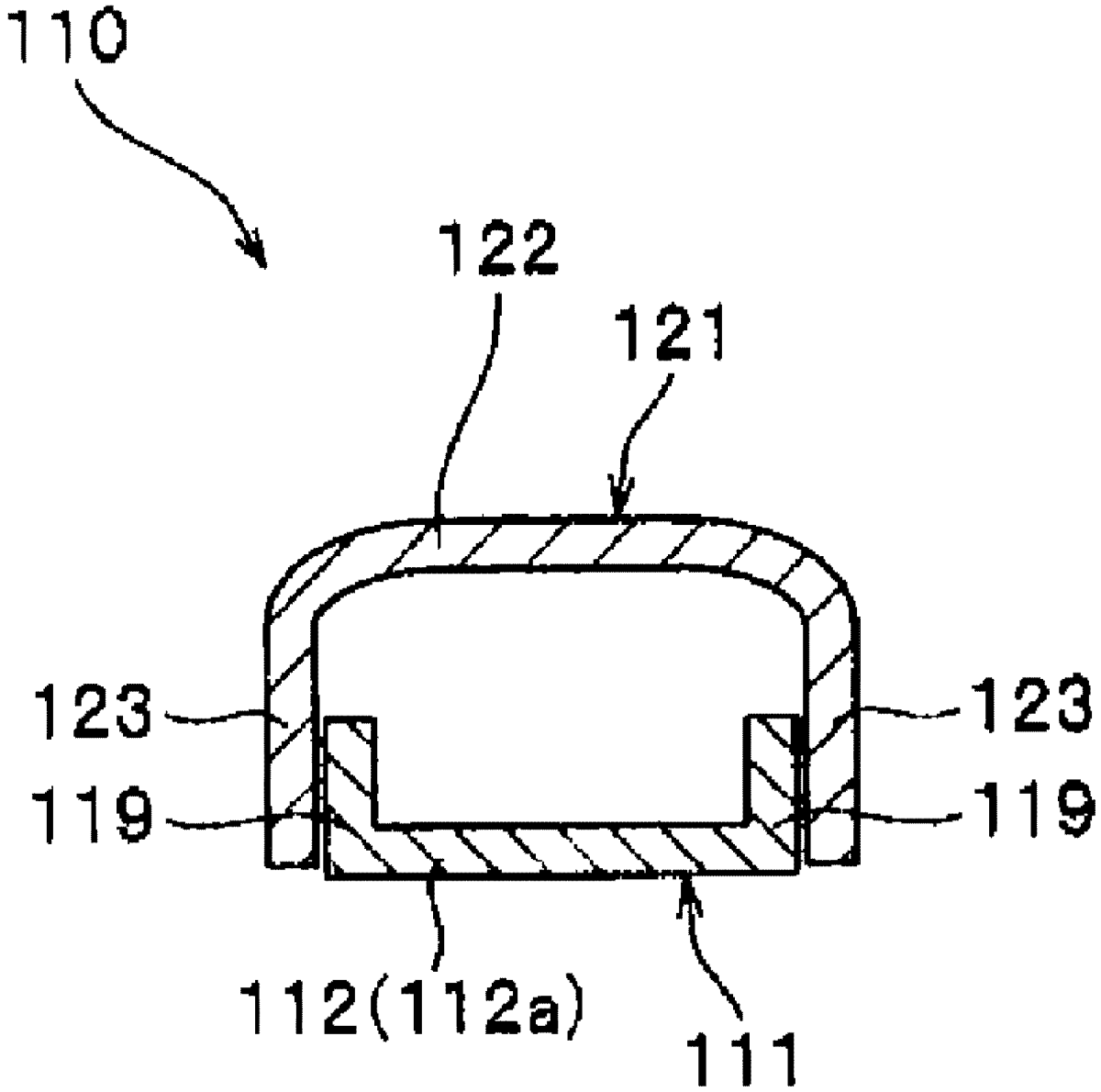
FIG. 15 A cross-sectional view taken along a line XV-XV shown in FIG. 13.

FIG. 13 is a schematic side view of a fastening implement according to a fourth embodiment of the present invention. FIG. 14 and FIG. 15 are cross-sectional views respectively taken along a line XIV-XIV and a line XV-XV shown in FIG. 13.

A fastening implement 14 according to the fourth embodiment includes a first fastening member 110 that is connected to one end portion of a chain member (not shown), and a second fastening member 130 that is connected to another end portion of the chain member. The first fastening member 110 according to the fourth embodiment is a yet another example of the fastening member according to the present invention. The second fastening member 130 is formed of a metal ring represented by two-dot chain lines in FIG. 14 and FIG. 15. The second fastening member 130 according to the fourth embodiment is a member to which the first fastening member 110 is coupled, and is an example of a coupling subject member including the coupling subject portion to which the fastening member according to the present invention is coupled.

The first fastening member 110 according to the fourth embodiment includes a base portion 111 that extends in the front-and-rear direction, a movable portion 121 that is supported to be capable of turning relative to the base portion 111 by the coupling shaft portion 60, and the torsional spring 75 that biases the movable portion 121. In this case, the base portion 111 is connected to the chain member. The movable portion 121 is turned to open and close the first fastening member 110. The torsional spring 75 and the coupling shaft portion 60 are substantially the same as the torsional spring 75 and the coupling shaft portion 60 used in the fastening implement 12 according to the foregoing second embodiment.

The base portion 111 includes a plate-like base-side body portion 112 that extend in the front-and-rear direction, right-and-left base-side wall portions 119 and right-and-left base-side support portions 113 that extend upward from right-and-left lateral edge portions of the base-side body portion 112, and a base-side coupling portion 116 that extends to be curved into a fish-hook shape or a circular-arc shape from the base-side body portion 112. In addition, the base portion 111 includes a turning stop portion 114 that extends in the front-and-rear direction from the base-side body portion 112, a first chain-connecting portion 115 that extends further in the front-and-rear direction from the turning stop portion 114, and a reinforcing rib 118 that is provided continuously with the turning stop portion 114 and the first chain-connecting portion 115.

The base-side body portion 112 includes a wide portion 112*a* in which a dimension in the width direction is uniform, a gradually tapered portion 112*b* in which the dimension in the width direction is gradually reduced from the wide portion 112*a* toward the base-side coupling portion 116, and a narrow portion 112*c* in which the dimension in the width direction is uniform and smaller than that in the wide portion 112*a* (refer to FIG. 14). With this, the base-side body portion 112 can be formed to have an appropriate thickness that allows the base-side body portion 112 to be easily held with fingers. In addition, the base-side coupling portion 116 is easily inserted through the second fastening member 130.

The right-and-left base-side wall portions 119 are each provided straight along the front-and-rear direction as a part of the wide portion 112*a* and a part of the gradually tapered portion 112*b* of the base-side body portion 112. The right-and-left base-side wall portions 119 each include a continuous wall portion in which a height dimension from an upper surface of the base-side body portion 112 to an upper end surface of each of the base-side wall portions 119 is continuously uniform in the side view of the first fastening member 110, and an inclined wall portion in which the height dimension is gradually reduced toward the base-side coupling portion 116 in the side view of the first fastening member 110. The inclined wall portion of each of the base-side wall portions 119 is arranged at an end portion in the front-and-rear direction of a corresponding one of the base-side wall portions 119, which is on a side where the base-side coupling portion 116 is provided. By providing this inclined wall portion, a part of the second fastening member 130 is easily guided toward an inner peripheral portion of the base-side coupling portion 116.

The right-and-left base-side support portions 113 are formed parallel to and integrally with the right-and-left base-side wall portions 119, respectively. The base-side support portions 113 each include an upper end portion that exhibits a circular-arc shape in the side view of the first fastening member 110. In addition, the coil portion 76 of the torsional spring 75 is inserted between the right-and-left base-side support portions 113.

The turning stop portion 114 and the first chain-connecting portion 115 each extend with a uniform thickness and continuously from the base-side body portion 112 in the front-and-rear direction. In addition, a dimension in the width direction of the turning stop portion 114 and a dimension in the width direction of the first chain-connecting portion 115 are each the same as a dimension in the width direction of the base-side body portion 112.

A connection hole portion 115*a* through which a part of the chain member is inserted is formed through the first chain-connecting portion 115. In this case, the first chain-connecting portion 115 refers to a part including a region in the front-and-rear direction, where at least the connection hole portion 115*a* is formed.

The reinforcing rib 118 includes right-and-left first ribs 118*a* that are provided in the front-and-rear direction along right-and-left lateral edge portions of the turning stop portion 114 and those of the first chain-connecting portion 115, and a second rib 118*b* that is provided along the right-and-left direction. The second rib 118*b* is provided at an edge portion in the front-and-rear direction of the first chain-connecting portion 115, which is on a side opposite to a side on which the turning stop portion 114 is provided. Both end portions in the right-and-left directions of the second rib 118*b* are coupled to the right-and-left first ribs 118*a*. Note that, a shape of the reinforcing rib 118 is not limited thereto. For example, the right-and-left first ribs 118*a* may each be provided to have a shape in which a height dimension of each of the first ribs 118*a* is gradually reduced toward the second rib 118*b* to incline an upper surface of each of the first ribs 118*a* in the side view of the first fastening member 110. In addition, the second rib 118*b* may be omitted.

The right-and-left first ribs 118*a* are coupled respectively to the right-and-left base-side support portions 113. In this case, at a coupling end portion each of the first ribs 118*a*, which is coupled to a corresponding one of the base-side support portions 113, a height dimension from an upper surface of the turning stop portion 114 is gradually increased toward the corresponding one of the base-side support portions 113.

The base-side coupling portion 116 extends to be curved upward into the fish-hook shape or the circular-arc shape from the narrow portion 112*c* of the base-side body portion 112. In the side view of the first fastening member 110, an inner space portion 117 is formed on an inner peripheral side of the base-side coupling portion 116. A distal end part of the base-side coupling portion 116 is gradually narrowed and thinned toward its distal end.

The base-side coupling portion 116 is formed to have a size relative to that of lateral cover portions 123 of the movable portion 121, in which, in the side view of the first fastening member 110 in the closed state, the gap G is secured between the distal end of the base-side coupling portion 116 and the lateral cover portions 123. Specifically, in this case, in the size that the base-side coupling portion 116 is formed to have, the gap G has a minimum value at which the second fastening member 130 is not inserted therethrough. In other words, the gap G is smaller than a thickness of the second fastening member 130 (for example, diameter of its circular shape in cross-section).

The movable portion 121 includes a movable-side body portion 122 that extends in the front-and-rear direction under the state in which the first fastening member 110 is closed, and the right-and-left lateral cover portions 123 that are provided on both right-and-left sides of the movable-side body portion 122 and that extend downward from the movable-side body portion 122 toward the base portion 111. At an end portion in the front-and-rear direction of the movable-side body portion 122, which is on the side close to the first chain-connecting portion 115, an operating portion 124 is provided to extend to be bent upward from the movable-side body portion 122. From another end portion in the front-and-rear direction of the movable-side body portion 122, which is on the side away from the first chain-connecting portion 115, the movable-side coupling portion 125 extends to be curved downward into a fish-hook shape or a circular-arc shape.

The movable-side body portion 122 has a shape conforming to the base-side body portion 112. Specifically, the movable-side body portion 122 includes a wide portion in which a dimension in the width direction is uniform, a gradually tapered portion in which the dimension in the width direction is gradually reduced from the wide portion toward the base-side coupling portion 116, and a narrow portion in which the dimension in the width direction is uniform and smaller than that in the wide portion.

The right-and-left lateral cover portions 123 are curved downward from lateral edge portions of the movable-side body portion 122, and then droop toward the base-side body portion 112 (refer to FIG. 13 and FIG. 15). Further, the lateral cover portions 123 are each provided along the front-and-rear direction as a part of the wide portion and a part of the gradually tapered portion of the movable-side body portion 122 (refer to FIG. 14).

The right-and-left lateral cover portions 123 are formed to include at least regions to be superimposed on the right-and-left base-side support portions 113 in the side view of the first fastening member 110 in the closed state. In addition, attachment recessed portions that allow the coupling shaft portion 60 to be attached are formed respectively on inner sides in the width direction of the right-and-left lateral cover portions 123.

The lateral cover portions 123 respectively include restriction edge portions 123*a* that extend from the movable-side body portion 122 while being inclined relative to the upper-and-lower direction in the side view of the first fastening member 110 in the closed state. The restriction edge portions 123*a* may each be curved from the movable-side body portion 122 relative to the upper-and-lower direction. The restriction edge portions 123*a* refer to edge portions in the front-and-rear direction of the lateral cover portions 123, which are close to a movable-side coupling portion 125. In a space region that is surrounded by the lateral cover portions 123, the movable-side body portion 122, and the movable-side coupling portion 125 of the movable portion 121, the inner peripheral angle θ1 to be formed between the restriction edge portions 123*a* and the movable-side body portion 122 is 90° or less. How high the inner peripheral angle θ1 according to the fourth embodiment is illustrated in FIG. 13. In the example illustrated in FIG. 13, the inner peripheral angle θ1 is a vertical angle to be formed between a lower edge of the movable-side body portion 122, which is hidden by the lateral cover portion 123, and a two-dot chain line imaginarily extended obliquely upward from the restriction edge portion 123*a*. There are no problems as long as the inner peripheral angle θ1 is set similar to the inner peripheral angle θ1 described in the first embodiment. For example, the inner peripheral angle θ1 may be less than 90° less, or may be 89° or less. In this case, a dimension in the front-and-rear direction of the lower edge portion of each of the lateral cover portions 123 is larger than a dimension in the front-and-rear direction of an upper edge portion of the same.

In the side view of the first fastening member 110 in the closed state, the minimum value of the gap G to be formed between the distal end portion of the base-side coupling portion 116 and each of the restriction edge portions 123*a* is smaller than the thickness of the second fastening member 130. With this, the second fastening member 130 can be stably retained within the inner space portion 117 of the first fastening member 110. In addition, the second fastening member 130 can be prevented from directly coming into contact with the movable-side body portion 122. With this, the second coupling ring 102 can be prevented from pushing the movable portion 121 in the opening direction.

The operating portion 124 according to the fourth embodiment includes a plate-like vertical wall portion 124*a* that extends to be bent upward from the end portion of the movable-side body portion 122 into a substantially orthogonal direction in the side view of the first fastening member 110 in the closed state, and a plate-like inclined portion 124*b* that extends to be bent obliquely from an upper end portion of the vertical wall portion 124*a* toward the side on which the first chain-connecting portion 115 is provided.

By this vertical wall portion 124*a*, the movable portion 121 can be widely turned relative to the base portion 111 in turning the movable portion 121 by pushing the operating portion 124 with a finger. In this way, the first fastening member 110 can be widely opened. In particular, the first fastening member 110 according to the fourth embodiment can be more widely opened than, for example, the first fastening members 50 and 80 according to the foregoing second embodiment and the foregoing third embodiment. In addition, by providing the inclined portion 124*b* to the operating portion 124, the operating portion 124 can be easily pushed with the finger. With this, ease of operating the first fastening member 110 can be increased.

Further, in the fourth embodiment, a dimension in the width direction of the operating portion 124, specifically, a dimension in the width direction of the inclined portion 124*b* is smaller than an interval between inner wall surfaces of the right-and-left first ribs 118*a* provided to the base portion 111. With this, the operating portion 124 can be prevented from interfering with the right-and-left first ribs 118*a* of the base portion 111. Thus, the movable portion 121 can be smoothly turned at a higher turning angle. A turnable range of the movable portion 121 may be, for example, approximately 90°. The turnable range of the movable portion 121 refers to a range where the movable portion 121 turns from the above-described closed position to the above-described full-open position.

In addition, in this case, the dimension in the width direction of the operating portion 124 to be secured, specifically, the dimension in the width direction of the inclined portion 124*b* to be secured may be increased unless the dimension exceeds the interval between the inner wall surfaces of the right-and-left first ribs 118*a*. With this, in pushing the operating portion 124 with the finger, a large area in which the operating portion 124 and the finger are held in contact with each other is easily secured. Thus, an operation to turn the movable portion 121 is facilitated.

In the present invention, the vertical wall portion 124*a* and the inclined portion 124*b* of the operating portion 124 are not particularly limited in shape. In the present invention, an entirety of the operating portion 124 may be formed into the fan shape or a designed shape such as a circular shape or the heart shape. Alternatively, only the inclined portion 124*b* of the operating portion 124 may be formed into the shape such as the heart shape. With this, the first fastening member 110 and the fastening implement 14 according to the fourth embodiment are enabled to give, for example, a charming impression, and value can be added to the first fastening member 110 and the fastening implement 14.

A thickness of the movable-side coupling portion 125 is uniform. The movable-side coupling portion 125 is curved downward into the fish-hook shape or the circular-arc shape from the narrow portion of the movable-side body portion 122. Under the state in which the first fastening member 110 is closed, this movable-side coupling portion 125 extends to a lower side relative to a height position of the upper surface of the base-side body portion 112. In addition, at least an inner peripheral portion of the movable-side coupling portion 125 comes into abutment against an outer peripheral portion of the base-side coupling portion 116. Even under the state in which the movable-side coupling portion 125 is held in abutment against the base-side coupling portion 116, the movable portion 121 is biased by the torsional spring 75 into a direction in which the movable-side coupling portion 125 is pressed against the base-side coupling portion 116.

Similar to the first fastening members 50 and 80 according to the second embodiment and the third embodiment, the first fastening member 110 according to the fourth embodiment allows the operations to open and close the first fastening member 110 to be easily performed only with one hand. With this, the operations to couple and separate the fastening implement 14 according to the fourth embodiment can be easily and smoothly performed only with one hand. Thus, the fourth embodiment also provides advantages similar to those of the second embodiment and the third embodiment.

Note that, in the present invention, the first fastening member 20 according to the first embodiment need not necessarily include the protruding piece portion 36. In addition, the first fastening member 20 according to the first embodiment need not necessarily include the locking recessed portion 26*a* or the locking-subject protruding portion 35*a*. In this case, the spring member described in the second embodiment to the fourth embodiment (such as torsional spring) may be provided to the coupling shaft portion 30.

In the first fastening member 110 according to the fourth embodiment, as a shape of the base-side body portion 112, a shape substantially the same as the shape described in the first embodiment except that the locking recessed portion 26*a* is omitted from the base-side body portion 22 may be employed.

In the first fastening members 20, 50, 80, and 110 according to the first embodiment to the fourth embodiment, the turning stop portions 24, 54, 84, and 114 against which the operating portions 34, 64, 94, and 124 are brought into abutment to stop the movable portions 31, 61, 91, and 121 from turning in the opening direction need not necessarily be provided. In addition, when the turning stop portions 24, 54, 84, and 114 are provided, the operating portions 34, 64, 94, and 124 may each be provided to have a shape that is accommodated within a range in the front-and-rear direction of a corresponding one of the movable-side body portions 32, 62, 92, and 122. In this case, for example, in the first embodiment, the turning stop portion 24 need not necessarily include the housing recessed portion 24*a* that is capable of housing the part of the movable portion 31 by allowing the part to be brought into abutment against the housing recessed portion 24*a* itself. In addition, when the operating portions 34, 64, 94, and 124 are each provided to have the shape that is accommodated within the range in the front-and-rear direction of the corresponding one of the movable-side body portions 32, 62, 92, and 122, the dimension in the right-and-left direction of each of the operating portions 34, 64, 94, and 124 (that is, width of each of the operating portions) may be freely set.

The movable portions 31, 61, 91, and 121 according to the first embodiment to the fourth embodiment are supported to be capable of turning relative to the base-side support portions 23, 53, 83, and 113 of the base portions 21, 51, 81, and 111 by the coupling shaft portions 30 and 60 that serve as the rotary shafts. Note that, the movable portions 31, 61, 91, and 121 according to the present invention may be supported to be turnable, for example, by being coupled to the base-side body portions 22, 52, 82, and 112 of the base portions 21, 51, 81, and 111 with the coupling shaft portions 30 and 60. In other words, the base-side support portions 23, 53, 83, and 113 may be included in the base-side body portions 22, 52, 82, and 112. In this case, the base-side body portions 22, 52, 82, and 112 may include the coupling shaft portions 30 and 60.

In the first fastening members 20, 50, 80, and 110 according to the first embodiment to the fourth embodiment, the dimensions in the width direction of the movable portions 31, 61, 91, and 121 may be set to be smaller than those of the base portions 21, 51, 81, and 111 so that the base portions wrap and house the movable portions from below.

In the first fastening members 20, 50, 80, and 110 according to the first embodiment to the fourth embodiment, the single base-side coupling portions 26, 56, 86, and 116 extend from the single base-side body portions 22, 52, 82, and 112. In addition, the single movable-side coupling portions 35, 65, 95, and 125 extend from the single movable-side body portions 32, 62, 92, and 122. In the present invention, in the first fastening members 20, 50, 80, and 110 according to the first embodiment to the fourth embodiment, a plurality of base-side coupling portions 26, 56, 86, and 116 may branch and extend from the single base-side body portions 22, 52, 82, and 112. In addition, a plurality of movable-side coupling portions 35, 65, 95, and 125 may branch and extend from the single movable-side body portions 32, 62, 92, and 122. In this case, as long as a part of each of the base-side coupling portions and a part of a corresponding one of the movable-side coupling portions can be superimposed on each other in a longitudinal direction of a corresponding one of the base portions, the base-side coupling portions and the movable-side coupling portions may be formed in the same number, or may be formed in different numbers.

In the first fastening members 20, 50, 80, and 110 according to the first embodiment to the fourth embodiment, the movable-side coupling portions 35, 65, 95, and 125 and the base-side coupling portions 26, 56, 86, and 116 each exhibit the shape that is curved into the fish-hook shape or the circular-arc shape. In the present invention, in the side view of each of the first fastening members 20, 50, 80, and 110, the shape that is curved into the fish-hook shape or the circular-arc shape of a corresponding one of the movable-side coupling portions 35, 65, 95, and 125 may be shapes such as a substantially L-shape, a substantially C-shape, and a substantially U-shape, or may be shapes similar to these shapes. The shape of each of the base-side coupling portions 26, 56, 86, and 116, which is curved into the fish-hook shape or the circular-arc shape, may be shapes such as a substantially L-shape, a substantially C-shape, and a substantially U-shape conforming to the shape of a corresponding one of the movable-side coupling portions 35, 65, 95, and 125, or may be shapes similar to these shapes so that the base-side coupling portions 26, 56, 86, and 116 are brought into contact with or face the outer peripheral portion or the inner peripheral portion of the corresponding one of the movable-side coupling portions 35, 65, 95, and 125.

In addition, in the present invention, in the side view of each of the first fastening members 20, 50, 80, and 110, as long as corresponding ones of the base-side coupling portions 26, 56, 86, and 116 and the movable-side coupling portions 35, 65, 95, and 125 are each formed into the shape that is curved upward or downward, these coupling portions need not necessarily be smoothly curved. For example, in the side view of each of the first fastening members 20, 50, 80, and 110, as long as the distal end portion of a corresponding one of the base-side coupling portions 26, 56, 86, and 116 has the shape curved toward a corresponding one of the movable-side body portions 32, 62, 92, and 122 of the movable portions 31, 61, 91, and 121, these coupling portions may each be formed into shapes such as an L-shape or a V-shape, may each be formed into shapes similar to these shapes, or may each be formed into an angular shape including at least a bent part. In the side view of each of the first fastening members 20, 50, 80, and 110, as long as the distal end portion of a corresponding one of the movable-side coupling portions 35, 65, 95, and 125 has the shape curved toward a corresponding one of the base-side body portions 22, 52, 82, and 112 of the base portions 21, 51, 81, and 111, these coupling portions may each be formed into the shapes such as the L-shape or the V-shape, may each be formed into the shapes similar to these shapes, or may each be formed into the angular shape including at least a bent part.

In the cases described in the first embodiment to the fourth embodiment, the fastening implements 11, 12, 13, and 14 are each the tennis bracelet or the chain bracelet. However, the present invention is not limited thereto. Accessories in which the fastening member or the fastening implement according to the present invention is used may be bracelets other than the tennis bracelet and the chain bracelet.

The accessory according to the present invention may not only encompass the bracelets but also, for example, a necklace, a pendant, and an anklet. In other words, the present invention is applicable not only to the bracelets, but also to the accessories such as the necklace, the pendant, and the anklet. Specifically, when the accessory is the necklace, the fastening member (first fastening member) according to the present invention may be used as a fastening implement that separably couples both end portions of a chain member of the necklace to each other, or may be used, for example, at a coupling part where the chain member and a charm are separably coupled to each other.

In addition, the fastening member (first fastening member) according to the present invention is not limited to the fastening member that separably couples at least parts of the accessory, specifically, couples both the end portions of the chain member of the necklace to each other, or couple the chain member and the charm to each other. The fastening member according to the present invention may be used also for separably coupling the accessory to the coupling subject portions of, for example, other members or parts that are formed independently of the accessory. For example, in hooking the charm as a decoration to the coupling subject member other than the accessory, such as a mount, the fastening member according to the present invention may be used as that of the charm so that the charm is coupled to the coupling subject member. In this case, a part of the coupling subject member such as the mount, to which the fastening member according to the present invention is directly coupled, corresponds to the coupling subject portion. In other words, the fastening member (first fastening member) according to the present invention may be a fastening member that separably couples at least parts of the accessory to each other, or may be a clasp member for accessory that separably couples the accessory to arbitrary coupling-subject members. Note that, the second fastening members 40, 70, 100, and 130 described in the first embodiment to the fourth embodiment are also the coupling subject members including the coupling subject portions to which the first fastening members 20, 50, 80, and 110 are coupled respectively.

In the present invention, the fastening member (first fastening member) can be easily formed to have a size that is increased or reduced along the linear member, and that is increased or reduced in thickness. With this, a range of options of the fastening implement that can be employed as those of the accessories can be significantly expanded. Thus, design, beauty, and the like of the accessories can be more advantageously expressed, for example, than expressed by the related-art spring-ring type fastening implement. In addition, the fastening member of the present invention is also capable of coupling a plurality of accessories to each other. For example, the fastening member according to the present invention may be used as that of an at least one of a first fastening implement of a first accessory and a second fastening implement of a second accessory so that the first fastening implement and the second fastening implement are coupled to each other. Also in this case, by applying the fastening member according to the present invention, design features of the accessories are not impaired.

Below, Appendix 1 to Appendix 12 relating to an aspect of the present invention are described.

[Appendix 1] A clasp member for accessory (20, 50, 80, 110) that is separably coupled to a coupling subject portion, and is characterized by including:

a base portion (21, 51, 81, 111) that is connected to a part of an accessory (1, 2); and a movable portion (31, 61, 91, 121) that is supported to be capable of turning relative to the base portion (21, 51, 81, 111), and that opens and closes the clasp member for accessory (20, 50, 80, 110) by the turning, the clasp member for accessory (20, 50, 80, 110) being characterized in that:

the base portion (21, 51, 81, 111) includes a base-side coupling portion (26, 56, 86, 116);

the base-side coupling portion (26, 56, 86, 116) is arranged on one side in a longitudinal direction of the base portion (21, 51, 81, 111), the one side being opposite to another side on which a connecting part of the base portion (21, 51, 81, 111) is arranged, the connecting part being connected to the part of the accessory (1, 2);

the movable portion (31, 61, 91, 121) includes a movable-side coupling portion (35, 65, 95, 125); and under a state in which the movable portion (31, 61, 91, 121) is arranged at a closed position where the movable portion (31, 61, 91, 121) closes the fastening member (20, 50, 80, 110), an inner peripheral portion or an outer peripheral portion of the movable-side coupling portion (35, 65, 95, 125) and an outer peripheral portion or an inner peripheral portion of the base-side coupling portion (26, 56, 86, 116) are held in contact with or face each other, and apart of the base-side coupling portion (26, 56, 86, 116) and a part of the movable-side coupling portion (35, 65, 95, 125) are superimposed on each other in the longitudinal direction of the base portion (21, 51, 81, 111).

[Appendix 2] The clasp member for accessory (20, 50, 80, 110) according to Appendix 1, in which the base-side coupling portion (26, 56, 86, 116) is curved to a side on which the movable portion (31, 61, 91, 121) is provided, and the movable-side coupling portion (35, 65, 95, 125) is curved to a side on which the base portion (21, 51, 81, 111) is provided.

[Appendix 3] The clasp member for accessory (20) according to Appendix 1 or 2, in which the movable portion (31) is locked to the base portion (21) at the closed position.

[Appendix 4] The clasp member for accessory (50, 80, 110) according to any one of Appendices 1 to 3, further including an elastic member that is arranged to bias the movable portion (61, 91, 121) toward the closed position in a turning direction.

[Appendix 5] The clasp member for accessory (50, 80, 110) according to Appendix 4, in which the elastic member is formed of a spring member (75), and the spring member (75) is attached to a coupling shaft portion (60) that couples the base portion (51, 81, 111) and the movable portion (61, 91, 121) to each other.

[Appendix 6] The clasp member for accessory (20, 50, 80, 110) according to any one of Appendices 1 to 5, in which the base portion (21, 51, 81, 111) includes a base-side body portion (22, 52, 82, 112) that extends in the longitudinal direction of the base portion (21, 51, 81, 111), and base-side support portions (23, 53, 83, 113)

that extend from the base-side body portion (22, 52, 82, 112) into a height direction of the base portion (21, 51, 81, 111), and that support the movable portion (31, 61, 91, 121), the base-side coupling portion (26, 56, 86, 116)

extends from the base-side body portion (22, 52, 82, 112) at a position away from the base-side support portions (23, 53, 83, 113), and is curved to a side on which the movable portion (31, 61, 91, 121) is provided, the movable portion (31, 61, 91, 121) includes a movable-side body portion (32, 62, 92, 122), and lateral cover portions (33, 63, 93, 123)

which extend from the movable-side body portion (32, 62, 92, 122) toward the base portion (21, 51, 81, 111), and at least a part of each of which is superimposed on a corresponding one of the base-side support portions (23, 53, 83, 113) in a side view of the fastening member (20, 50, 80, 110), and an operating portion (34, 64, 94, 124) that extends from one end portion of the movable-side body portion (32, 62, 92, 122) into a direction curved relative to the movable-side body portion (32, 62, 92, 122), the movable-side coupling portion (35, 65, 95, 125) is curved from another end portion of the movable-side body portion (32, 62, 92, 122) to a side on which the base portion (21, 51, 81, 111) is provided, and the lateral cover portions (33, 63, 93, 123) are coupled to the base-side support portions (23, 53, 83, 113) of the base portion (21, 51, 81, 111) with the coupling shaft portion (30, 60).

[Appendix 7] The clasp member for accessory (20, 110) according to Appendix 6, in which the lateral cover portions (33, 123) include restriction rim portions (33*a*, 123*a*) that are arranged on the one side in the longitudinal direction, and, in the side view of the fastening member (20, 110), an inner peripheral angle (01) to be formed between the movable-side body portion (32, 122) and the restriction rim portions (33*a*, 123*a*) of the lateral cover portions (33, 123) within a space that is surrounded by the lateral cover portions (33, 123), the movable-side body portion (32, 122), and the movable-side coupling portion (35, 125) is 90° or less.

[Appendix 8] The clasp member for accessory (20, 50, 80, 110) according to Appendix 6 or 7, in which, under the state in which the movable portion (31, 61, 91, 121) is arranged at the closed position, the lateral cover portions (33, 63, 93, 123) are superimposed on at least a part of the base-side body portion (22, 52, 82, 112) in the side view of the fastening member (20, 50, 80, 110).

[Appendix 9] The clasp member for accessory (20, 50, 80, 110) according to any one of Appendices 6 to 8, in which the base portion (21, 51, 81, 111) includes a turning stop portion (24, 54, 84, 114)

that extends from the base-side body portion (22, 52, 82, 112) to the other side that is opposite in the longitudinal direction to the one side on which the base-side coupling portion (26, 56, 86, 116) is provided, and that stops the movable portion (31, 61, 91, 121) from turning in an opening direction by allowing the operating portion (34, 64, 94, 124) to come into abutment against the turning stop portion (24, 54, 84, 114).

[Appendix 10] A clasp for accessory, characterized by including:

a first fastening member (20, 50, 80, 110) being the clasp member for accessory (20, 50, 80, 110) according to any one of Appendices 1 to 9; and a second fastening member (40, 70, 100, 130) including the coupling subject portion.

[Appendix 11] The clasp for accessory according to Appendix 10, in which the first fastening member (20, 50, 80, 110) is arranged at one end portion of a linear member (5, 8) of the accessory (1, 2), the second fastening member (40, 70, 100, 130) is arranged at another end portion of the linear member (5, 8), and the base-side coupling portion (26, 56, 86, 116) and the movable-side coupling portion (35, 65, 95, 125) of the first fastening member (20, 50, 80, 110) are inserted through an insertion hole portion (42*a*, 72*a*, 102*a*) provided through the second fastening member (40, 70, 100, 130) so that the first fastening member (20, 50, 80, 110) and the second fastening member (40, 70, 100, 130) are separably coupled to each other.

[Appendix 12] An accessory including the clasp member for accessory (20, 50, 80, 110) according to any one of Appendices 1 to 9.

According to the above-described aspect, operations to open and close the fastening member, and operations to couple and separate the fastening implement can be easily and smoothly performed. In addition, a coupled state of the fastening implement can be stably maintained.

The invention claimed is:

1. A clasp member for an accessory that is separably coupled to a coupling subject portion, the clasp member comprising:

a base portion that is connected to a part of the accessory, wherein the base portion further comprises:

a base-side coupling portion arranged on one side in a longitudinal direction of the base portion, the one side being opposite to another side on which a connecting part of the base portion is arranged, the connecting part being connected to the part of the accessory, a base-side body portion that extends in the longitudinal direction of the base portion, base-side support portions that extend from the base-side body portion into a height direction of the base portion; and a movable portion that is supported by the base-side support portions, and configured to turn relative to the base portion, wherein the turning opens and closes the clasp member for the accessory wherein the movable portion further comprises:

a movable-side coupling portion, a movable-side body portion, wherein the movable-side coupling portion is curved from another end portion of the movable-side body portion to a side on which the base portion is provided, lateral cover portions which extend from the movable-side body portion toward the base portion, and at least a part of each of which is superimposed on a corresponding one of the base-side support portions in a side view of the fastening member, wherein the lateral cover portions are coupled to the base-side support portions of the base portion with a coupling shaft portion, and an operating portion that extends from one end portion of the movable-side body portion into a direction curved relative to the movable-side body portion, and, under a state in which the movable portion is arranged at a closed position where the movable portion closes a fastening member, an inner peripheral portion or an outer peripheral portion of the movable-side coupling portion and an outer peripheral portion or an inner peripheral portion of the base-side coupling portion are held in contact with or face each other, and a part of the base-side coupling portion and a part of the movable-side coupling portion are superimposed on each other in the longitudinal direction of the base portion, wherein the base-side coupling portion extends from the base-side body portion at a position away from the base-side support portions, and is curved to a side on which the movable portion is provided.

2. The clasp member for accessory according to claim 1, wherein the movable portion is locked to the base portion at the closed position.

3. The clasp member for the accessory according to claim 1, further comprising:

an elastic member that is arranged to bias the movable portion toward the closed position in a turning direction.

4. The clasp member for the accessory according to claim 3, wherein the elastic member is formed of a spring member, and the spring member is attached to the coupling shaft portion that couples the base portion and the movable portion to each other.

5. The clasp member for the accessory according to claim 1, wherein the lateral cover portions include restriction rim portions that are arranged on the one side in the longitudinal direction, and, in the side view of the fastening member, an inner peripheral angle to be formed between the movable-side body portion and the restriction rim portions of the lateral cover portions within a space that is surrounded by the lateral cover portions, the movable-side body portion, and the movable-side coupling portion is 90° or less.

6. The clasp member for the accessory according to claim 1, wherein, under the state in which the movable portion is arranged at the closed position, the lateral cover portions are superimposed on at least a part of the base-side body portion in the side view of the fastening member.

7. The clasp member for the accessory according to claim 1, wherein the base portion further comprises:

a turning stop portion that extends from the base-side body portion to the other side that is opposite in the longitudinal direction to the one side on which the base-side coupling portion is provided, and that stops the movable portion from turning in an opening direction by allowing the operating portion to come into abutment against the turning stop portion.

8. A clasp for the accessory, comprising:

a first fastening member being the clasp member for the accessory according to claim 1; and a second fastening member including the coupling subject portion.

9. The clasp for the accessory according to claim 8, wherein the first fastening member is arranged at one end portion of a linear member of the accessory, the second fastening member is arranged at another end portion of the linear member, and the base-side coupling portion and the movable-side coupling portion of the first fastening member are inserted through an insertion hole portion provided through the second fastening member so that the first fastening member and the second fastening member are separably coupled to each other.

* * * * *